United States Patent [19]

Uchiyama

[11] Patent Number: 4,841,827

[45] Date of Patent: Jun. 27, 1989

[54] INPUT APPARATUS OF ELECTRONIC SYSTEM FOR EXTRACTING PITCH DATA FROM INPUT WAVEFORM SIGNAL

[75] Inventor: Shigeru Uchiyama, Sayama, Japan

[73] Assignee: Casio Computer Co., Ltd., Tokyo, Japan

[21] Appl. No.: 252,914

[22] Filed: Oct. 3, 1988

[30] Foreign Application Priority Data

Oct. 8, 1987 [JP] Japan ..... 62-254169

[51] Int. Cl.[4] ..... G10H 3/18; G10H 7/00

[52] U.S. Cl. ..... 84/1.01; 84/1.16; 84/1.28; 84/DIG. 10

[58] Field of Search ..... 84/1.01, 1.14–1.16, 84/1.28, DIG. 10; 340/146.2; 364/768, 769, 487

[56] References Cited

U.S. PATENT DOCUMENTS

| | | | |
|---|---|---|---|
| Re. 30,834 | 12/1981 | Niimi et al. | 84/1.01 |
| 4,117,757 | 10/1978 | Akamatu . | |
| 4,606,255 | 9/1986 | Hayashi et al. . | |
| 4,633,748 | 1/1987 | Takashima et al. . | |
| 4,679,480 | 7/1987 | Suzuki | 84/DIG. 10 |
| 4,688,464 | 8/1987 | Gibson et al. . | |
| 4,785,706 | 11/1988 | Toshifumi | 84/1.28 X |
| 4,785,707 | 11/1988 | Suzuki | 84/1.28 X |

FOREIGN PATENT DOCUMENTS

| | | |
|---|---|---|
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-37074 | 8/1982 | Japan . |
| 57-58672 | 12/1982 | Japan . |
| 61-51793 | 11/1986 | Japan . |
| 62-20871 | 5/1987 | Japan . |

*Primary Examiner*—Stanley J. Witkowski

*Attorney, Agent, or Firm*—Frishauf, Holtz, Goodman & Woodward

[57] ABSTRACT

An input waveform signal is converted into a digital peak value signal by an A/D converter, and the digital peak value signal is input to one input terminal A of a comparator. The other input terminal B of the comparator receives a preset digital peak value signal from a memory. These input signals are compared by the comparator. The content of the memory is reduced at a predetermined rate. If the comparator detects that the currently input waveform level is larger than the continuously reduced level of the memory, i.e., if A>B, a new waveform level is loaded in the memory. As a result, the output from the comparator is inverted. That is, condition A>B is changed into condition A<B. The timing of this change in condition serves as a peak timing of the input waveform signal.

12 Claims, 19 Drawing Sheets

INPUT APPARATUS OF ELECTRONIC SYSTEM FOR EXTRACTING PITCH DATA FROM INPUT WAVEFORM SIGNAL

BACKGROUND OF THE INVENTION

1. Field of the Invention

The present invention relates to an apparatus for extracting pitch data from an input waveform signal and an electronic system of a type for generating a musical tone having a pitch corresponding to extracted pitch data and, more particularly, to an electronic stringed instrument such as an electronic guitar or a guitar synthesizer.

2. Description of the Related Art

In recent years, various types of electronic systems have been developed to extract pitch (fundamental frequency) data from a waveform signal generated in accordance with human varies and/or tones of acoustic musical instruments and to control a sound source constituted by an electronic circuit so as to artificially obtain an acoustic effect such as a musical tone.

The following prior arts disclose the above technique:

U.S. Pat. No. 4,117,757 (issued on Oct. 3, 1978), inventor: Akamatsu,

U.S. Pat. No. 4,606,255 (issued on Aug. 19, 1986), inventors: Hayashi et al.,

U.S. Pat. No. 4,633,748 (issued on Jan. 6, 1987), inventors: Takashima et al.,

U.S. Pat. No. 4,688,464 (issued on Aug. 25, 1987), inventors: Gibson et al.,

Japanese Patent Publication No. 57-37074 (published on Aug. 7, 1982), applicant: Roland Kabushiki Kaisha, Japanese Patent Publication No. 57-58672 (published on Dec. 10, 1982), applicant: Roland Kabushiki Kaisha, Japanese Patent Disclosure (Kokai) No. 55-55398 (disclosed on Apr. 23, 1980), applicant: TOSHIBA CORP., Japanese Patent Disclosure (Kokai) No. 55-87196 (disclosed on July 1, 1980), applicant: Nippon Gakki Co., Ltd., Japanese Patent Disclosure (Kokai) No. 55-159495 (disclosed on Dec. 11, 1980), applicant: Nippon Gakki Co., Ltd., Japanese Utility Model Disclosure (Kokai) No. 55-152597 (disclosed on Nov. 4, 1980), applicant: Nippon Gakki Co., Ltd., Japanese Utility Model Disclosure (Kokai) No. 55-162132 (disclosed on Nov. 20, 1980) applicant: Keio Giken Kogyo Kabushiki Kaisha, Japanese Patent Publication No. 61-51793 (published on Nov. 16, 1986), applicant: Nippon Gakki Co., Ltd., and Japanese Utility Model Publication No. 62-20871 (published on May 27, 1987), applicant: Fuji Roland Kabushiki Kaisha.

U.S. patent application disclosing a system relating to the present invention was filed by Uchiyama et al. as U.S. Ser. No. 112,780 on Oct. 22, 1987.

In these prior arts, in order to extract pitch data from an input waveform signal, a time interval between two positive peaks, between negative peaks, or between zero-crossings immediately after these peaks of the input waveform signal is measured. A circuit for detecting a peak is generally exemplified by an analog circuit including capacitors and resistors. It is often difficult to perform good peak detection of the input waveform signal of the musical instrument due to variations in circuit components, durability, and deteriorations over time. The peak detector comprises an analog system which requires a large number of circuit components, resulting in high cost. It is also inconvenient to realize easy element mounting. In particular, in an electronic musical instrument incorporating a sound source circuit, a mounting space must be minimized. In a conventional circuit arrangement, it is impossible or is very difficult to obtain a mounting space. When condition parameters are to be changed for pitch extraction, special circuits must be prepared every time the parameters are changed. Therefore, it is very difficult to change such parameters.

SUMMARY OF THE INVENTION

It is an object of the present invention to provide an apparatus for extracting a pitch data from an input waveform signal or an input apparatus for an electronic system for generating a musical tone corresponding to the pitch data, wherein a circuit arrangement is simple and inexpensive, and peak detection can be performed with high precision, and condition parameters can be easily changed regardless of variations in circuit components and deteriorations over time.

A major part of a circuit arrangement for extracting a pitch data from an input waveform signal is constituted by a digital system.

According to an aspect of the present invention, there is provided an input control apparatus for an electronic system, comprising:

means for converting an input waveform signal into a digital waveform signal A;

memory means for storing a digital waveform signal B;

means for reducing a value of the digital waveform signal B stored in said memory means at a predetermined rate;

means for comparing the digital waveform signal B stored in said memory means with the digital waveform signal A supplied from said converting means; and control means for causing said memory means to store the digital waveform signal A supplied from said converting means as the digital waveform signal B when said comparing means detects that the digital waveform signal A supplied from said converting means is larger than the digital waveform signal B stored in said memory means, and for inhibiting changing the digital waveform signal B stored said memory means with the digital waveform signal A when said comparing means detects that the digital signal A supplied from said converting means is smaller than the digital waveform signal B stored in said memory means, wherein a peak timing of the input waveform signal is detected on the basis of a comparison output from said comparing means.

The present invention is applied to an electronic stringed instrument having a plurality of strings, and there is provided an input control apparatus for an electronic musical instrument of a type having a plurality of strings to extract a pitch from a vibration signal generated upon vibrations of the strings and electrically generate an acoustic signal having a frequency corresponding to the extracted pitch, comprising:

means for converting an input waveform signal into digital waveform signals Ai, where i corresponds to a string number of the strings;

memory means for storing digital waveform signals Bj, where j corresponds to the string number of the strings;

means for subtracting a predetermined value from the digital waveform signal Bj of each string stored in said memory means at a predetermined rate;

means for comparing the digital waveform signal Bj stored in said memory means with the digital waveform signal Ai supplied from said converting means in units of strings (i=j); and control means for causing said memory means to store the digital waveform signal Ai supplied from said converting means as the corresponding digital waveform signal Bj (j=i) in said memory means when said comparing means detects that the digital waveform signal Ai supplied from said converting means is larger than the corresponding digital waveform signal Bj (j=i) stored in said memory means, and for inhibiting changing the digital waveform signal Bj stored the memory means with the digital waveform signal A when said comparing means detects that the digital waveform signal Ai supplied from said converting means is smaller than the corresponding digital waveform signal Bj (j=i) stored in said memory means, wherein peak timings of the input waveform signals generated upon vibrations of the plurality of strings are detected on the basis of a comparison result from said comparing means.

By developing the above arrangement, positive and negative peaks of the input waveform signal generated by each string can be detected. In this case, positive digital waveform signals Bju and negative digital waveform signals BjD having the inverted polarity for the respective strings are stored in the memory means. The positive peak value is output without processing and the negative peak value is output after its polarity is inverted, thereby obtaining digital waveform signal Ai. Digital waveform signal Ai is compared with digital waveform signals Bju and BjD to detect both positive and negative peak timings.

BRIEF DESCRIPTION OF THE DRAWINGS

The above and other objects, features, and advantages of the present invention will be apparent from a preferred embodiment in conjunction with the accompanying drawings, in which.

DETAILED DESCRIPTION OF THE PREFERRED EMBODIMENT

A preferred embodiment of the present invention will be described in detail with reference to the accompanying drawings. The present invention is applied to an electronic guitar but can also be applied to electronic musical instruments of other types or other electronic systems.

Figure 1:
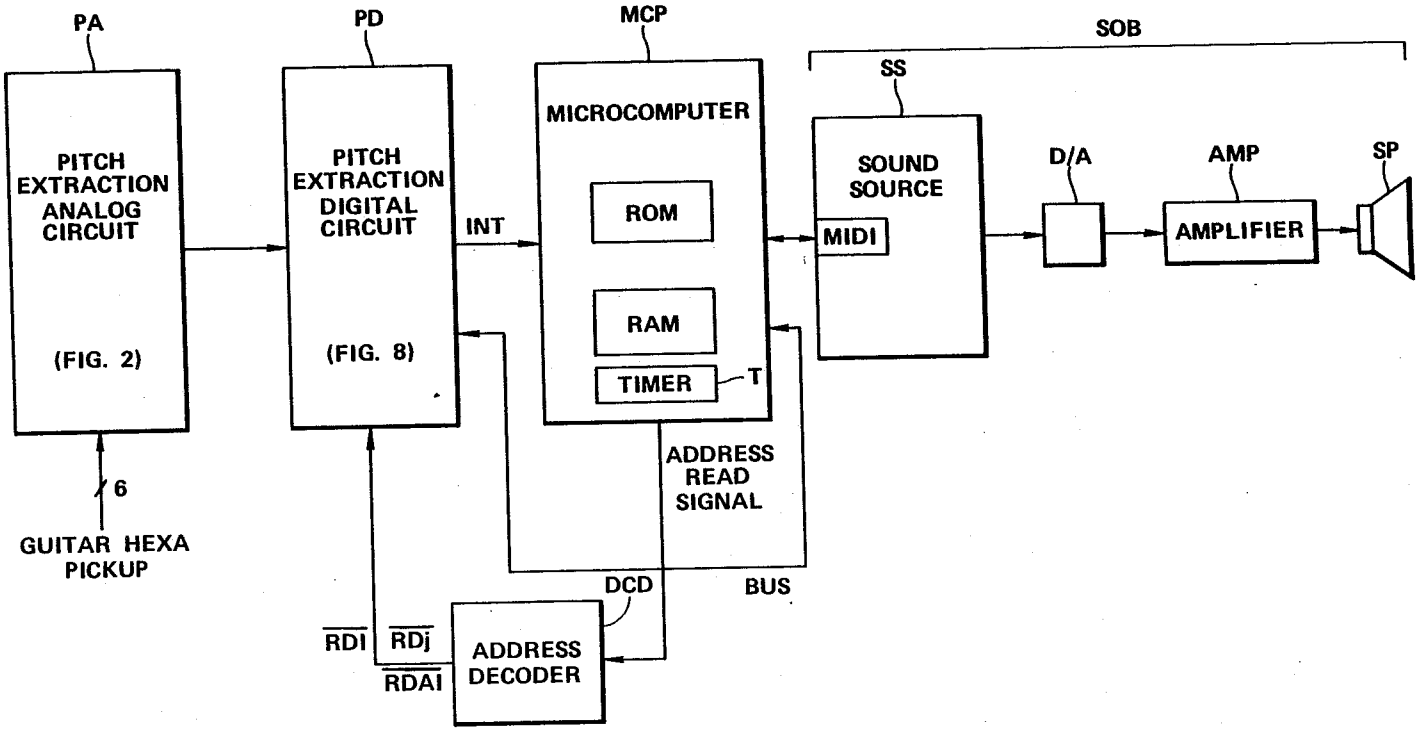
FIG. 1 is a diagram showing an overall arrangement of an embodiment of the present invention.

FIG. 1 is a block diagram showing an overall circuit arrangement. Pitch extraction analog circuit PA to be described in detail later is arranged for each of six strings which are kept taut on an electronic guitar body (not shown). Circuit PA inclues a hexa pickup for converting string vibrations into electrical signals and a converting means such as analog-to-digital converter A/D (to be described in detail later) for outputting zero-crossing signals Zi and waveform signals Wi (i=1 to 6) on the basis of outputs from the pickup and converting these signals into time-divisional serial zero-crossing signal ZCR and digital output (time-divisional waveform signal) D1.

Figure 8:
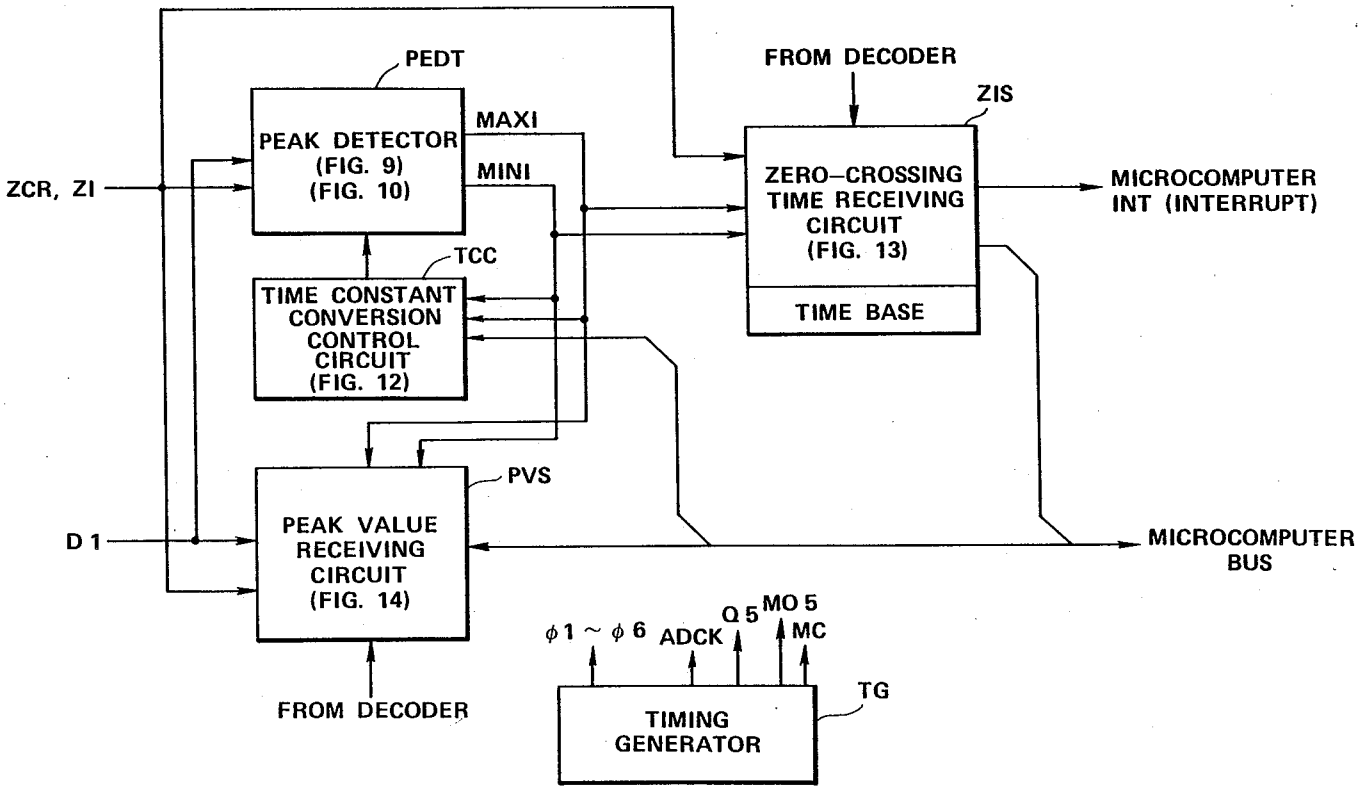
FIG. 8 is a block diagram of a pitch extraction digital circuit shown in FIG. 1.

Pitch extraction digital circuit PD will be described later. Digital circuit PD includes peak detector PEDT, time constant conversion control circuit TCC, peak value receiving circuit PVS, and zero-crossing time receiving circuit ZTS, as shown in FIG. 8. Digital circuit PD detects the positive or negative peak value on the basis of zero-crossing signals Zi, serial zero-crossing signal ZCR, and digital output D1, all of which are output from pitch extraction analog circuit PA, generates MAXI and MINI (I=1 to 6) and outputs interrupt signal INT at a zero-crossing to microcomputer MCP. In addition, pitch extraction digital circuit PD outputs time information and peak value information at the zero-crossing, and an instantaneous value of the input waveform signal to microcomputer MCP through bus BUS. Peak detector PEDT includes a circuit for subtracting previous peak values and holding a subtracted value.

Microcomputer MCP includes memories (e.g., a ROM and a RAM) and timer T and controls signals supplied to musical tone generator SOB. Generator SOB comprises sound source SS, digital-to-analog converter D/A, amplifier AMP, and loudspeaker SP and generates a musical tone having a pitch designated by a pitch designation signal for changing a frequency and controlled by the signals of note-on (tone generation) and note-off (muting) which are supplied from microcomputer MCP. Interface MIDI (Musical Instrument Digital Interface) is arranged between the input side of sound source SS and the microcomputer MCP. In response to address read signal AR, address decoder DCD outputs string number read signal $\overline{RDI}$, time read signal $\overline{RDj}$ (j=1 to 6), and MAX and MIN peak read signals $\overline{RDAI}$ (I=1 to 12) to pitch extraction digital circuit PD.

Figure 2A:
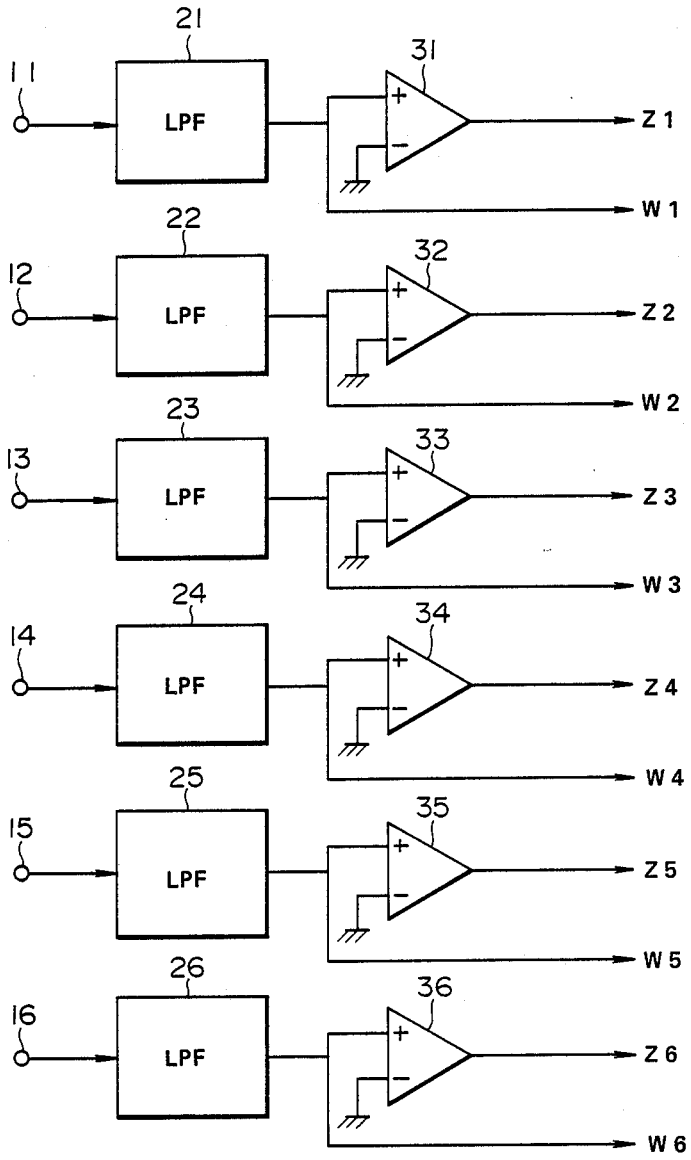
FIGS. 2A and 2B are diagrams showing a detailed arrangement of a pitch extraction analog circuit in FIG. 1.
Figure 2B:
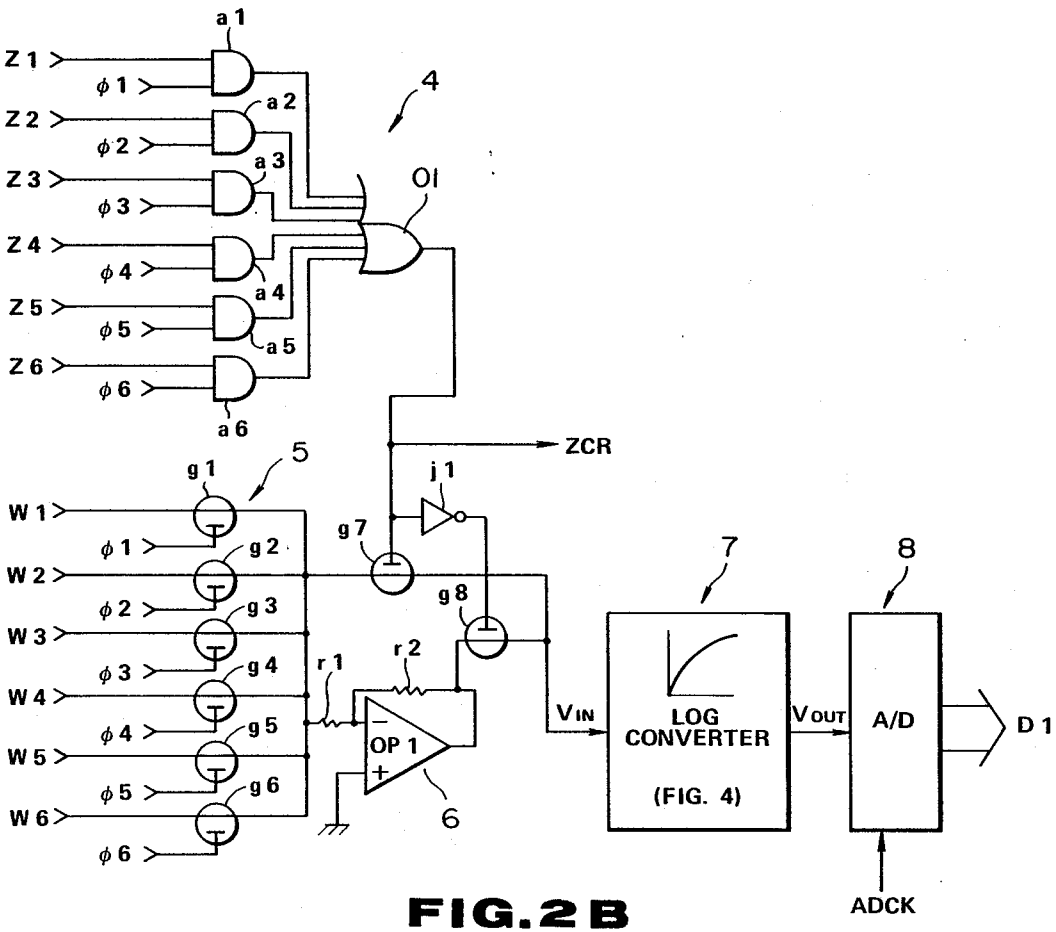

FIGS. 2A and 2B are circuit diagrams showing a detailed arrangement of pitch extraction analog circuit PA in FIG. 1. Input waveform signals corresponding to the respective strings and output from the hexa pickup are supplied to input terminals 11 to 16 of low-pass filters (LPFs) 21 to 26, respectively. These signals are amplified, and their high-frequency components are removed, so that the fundamental waveforms are extracted. Since a frequency of an output tone of each string falls within a predetermined two-octave range, these LPFs have different cutoff frequencies in units of strings.

Outputs from low-pass filters 21 to 26, are supplied as waveform outputs W1 to W6. The outputs from the low-pass filters 21 to 26 are also input to zero-crossing comparators 31 to 36, respectively, and are compared with a reference signal, thereby generating zero-crossing signals Z1 to Z6.

Zero-crossing signals Z1 to Z6 are input to an input section of zero-crossing parallel-to-serial converter 4 comprising AND gates a1 to a6 and OR gate $\phi$1. More specifically, signals Z1 to Z6 are respectively input to AND gates a1 to a6 which are sequentially enabled in response to pulses $\phi$1 to $\phi$6 (to be described later), so that signals Z1 to Z6 are converted into serial zero-crossing signal ZCR. In this case, converter 4 outputs serial zero-crossing signal ZCR of logic "1" if values of signals Z1 to Z6 are positive. However, converter 4 outputs serial zero-crossing signal ZCR of logic "0" if the values of signals Z1 to Z6 are negative.

Waveform outputs W1 to W6 from low-pass filters 21 to 26 are input to the input section of analog parallel-serial converter 5, i.e., analog gates g1 to g6. Analog gates g1 to g6 are sequentially enabled in response to pulses $\phi$1 to $\phi$6, so that outputs W1 to W6 are converted into an analog serial signal. In this case, gates g1 to to g6 are enabled when pulses $\phi$1 to $\phi$6 are set at high level. However, analog gates g1 to g6 are disabled when pulses $\phi$1 to $\phi$6 are set at low level. An output from converter 5 is input to inverting amplifier (OPl) 6 connected to resistors r1 and r2. The positive and negative waveforms are converted into positive waveforms. More specifically, serial zero-crossing signal ZCR from converter 4 is directly input to analog gate g7 and to the gate terminal of analog gate g8 through inverter il. An output from inverting amplifier 6 is input to the input terminal of analog gate g8. Therefore, the output from analog gate g8 always has a positive value. Analog gate g7 is enabled in response to serial zero-crossing signal ZCR of logic "1", and outputs from analog gates g1 to g6 are gated to the output terminal. Therefore, the output signals always have positive values.

Outputs from analog gates g7 and g8 are input to log converter 7. The waveform data is log-converted by log converter 7 into compressed data. Necessary memory bits are eliminated. An output from log converter 7 is converted into digital output D1 by analog-to-digital converter (to be referred to as an A/D converter hereinafter) 8 in accordance with a logical state of A/D conversion clock signal ADCK.

Figure 3:
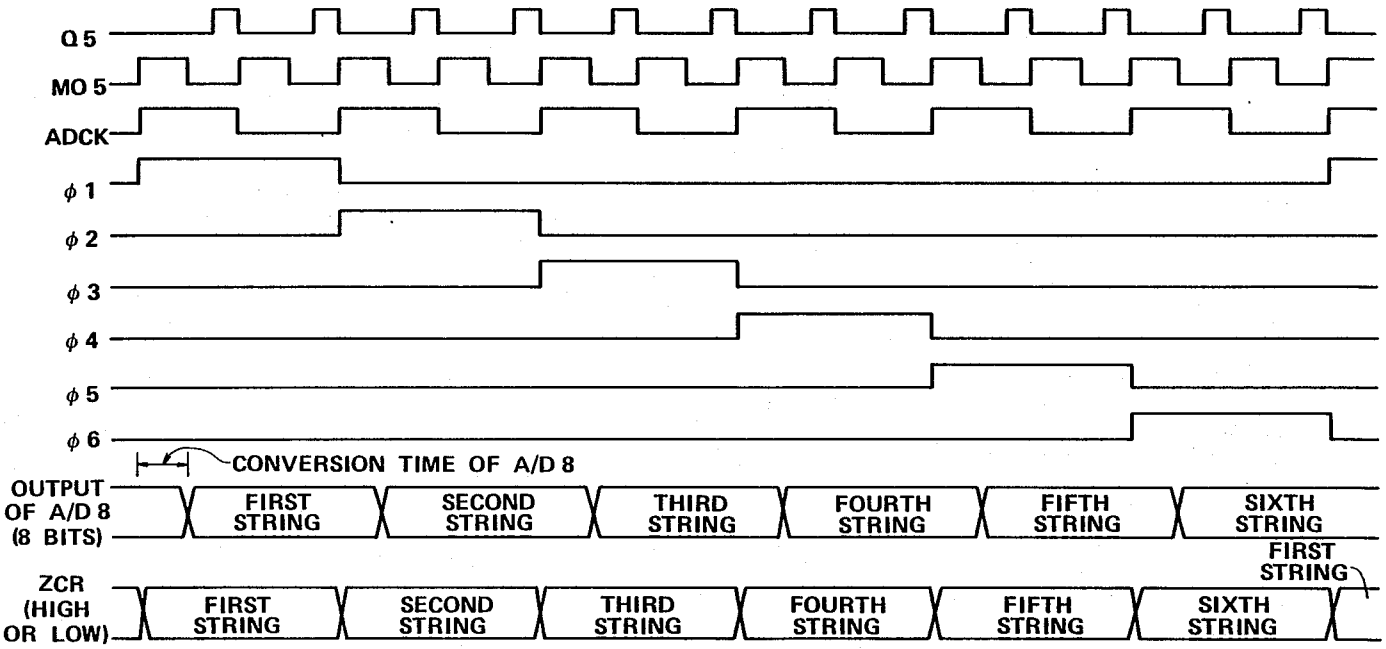
FIG. 3 is a timing chart for explaining the operation of the pitch extraction analog circuit.

FIG. 3 is a timing chart for explaining the operation of pitch extraction analog circuit PA in FIG. 2. Sequential pulses $\phi$1 to $\phi$6 are output from timing generator TG (FIG. 8) (to be described later) and are generated in order upon every interval corresponding to two periods of A/D conversion clock signal ADCK. Serial zero-crossing signal ZCR generated in response pulses $\phi$1 to $\phi$6 represents a zero-crossing of each string. Digital output D1 represents peak values (the polarity is inverted to obtain a positive value) of each string. Digital output D1 is delayed by a conversion time of A/D converter 8 from sequential pulses $\phi$1 to $\phi$6. This delay time can be corrected in a manner to be described later. Referring to FIG. 3, reference symbols Q5 and M05 denote timing signals output from pitch extraction digital circuit PD shown in FIG. 8, and functions of these signals will be described later.

Figure 4:
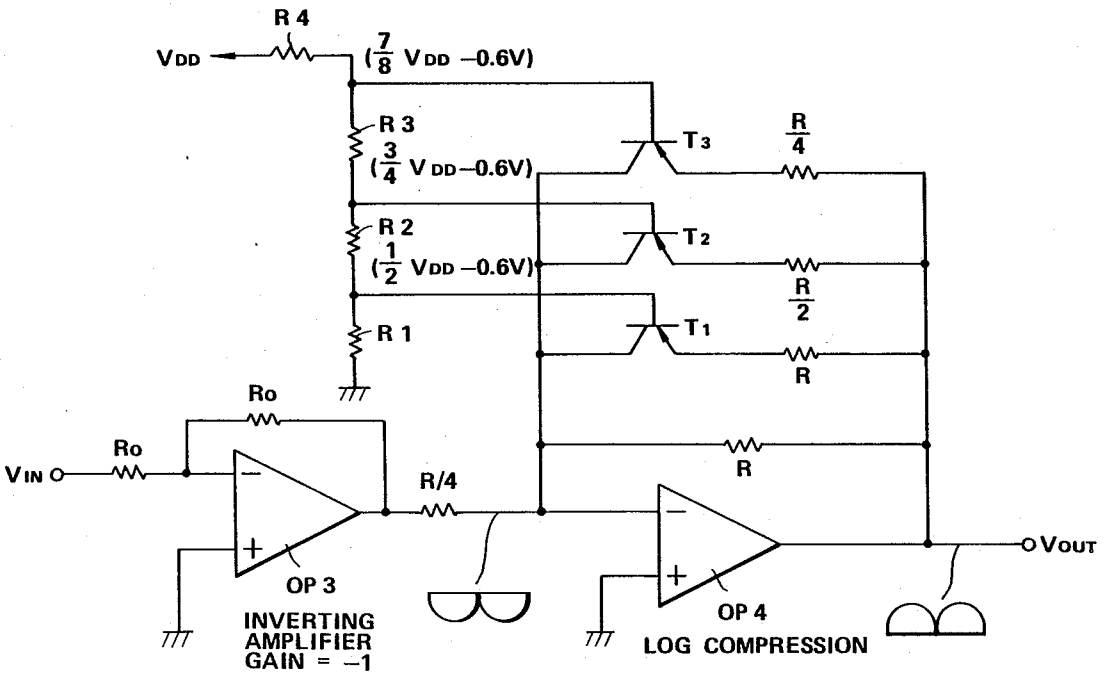
FIG. 4 is a diagram showing a detailed arrangement of a log converter in FIG. 2B.

FIG. 4 is a circuit diagram showing a detailed arrangement of log converter 7 in pitch extraction analog circuit PA shown in FIGS. 2A and 2B. Log converter 7 comprises a four-polygonal approximation log converter but is not limited thereto.

Log converter 7 comprises inverting amplifiers OP3 and OP4, transistors Tl, T2, and T3, and resistors R0, RO, Rl, R2, R3, R4, R, R, R/2, and R/4. Resistances of resistors R2 to R4 are determined to obtain voltage VOUT below:

$$R2=(\tfrac{1}{2})VDD-0.6v$$

$$R3=(\tfrac{3}{4})VDD-0.6v$$

$$R4=(\tfrac{7}{8})VDD-0.6v.$$

With this arrangement, (1) If condition VOUT $<(\tfrac{1}{2})$VDD is established, transistors T1 to T3 are kept off. In this case, gain A can be calculated to be 4 according to the following equation:

$$A=VOUT/VIN=R/(R/4)=4.$$

(2) If condition $(\tfrac{1}{2})VDD<VOUT<(\tfrac{3}{4})VDD$ is established, transistors T2 and T3 are kept off. However, since the emitter voltage vs. base voltage of transistor T1 exceeds −0.6 v, transistor T1 is turned on. Most of the emitter current flows in the collector. For this reason, a feedback resistance of second inverting amplifier OP4 is given as R/2. Gain A is reduced into $\tfrac{1}{2}$ that of case (1), i.e., 2 as follows:

$$A=[1/(1/R+1/R)]/(R/4)=2.$$

(3) If condition $(\tfrac{3}{4})VDD<VOUT<(\tfrac{7}{8})VDD$ is established, transistors T1 and T2 are turned on while transistor T3 is kept off. In this case, gain A can be calculated to be 1 according to the following equation:

$$A=[1/(1/R+1/R+2/R)]/(R/4)=1.$$

(4) If condition $(\tfrac{7}{8})VDD<VOUT$ is established, transistors T1 to T3 are turned on. Gain A can be calculated to be 0.5 according to the following equation:

$$A=[1/(1/R+1/R+2/R+4/R)]/(R/4)=0.5.$$

Figure 5:
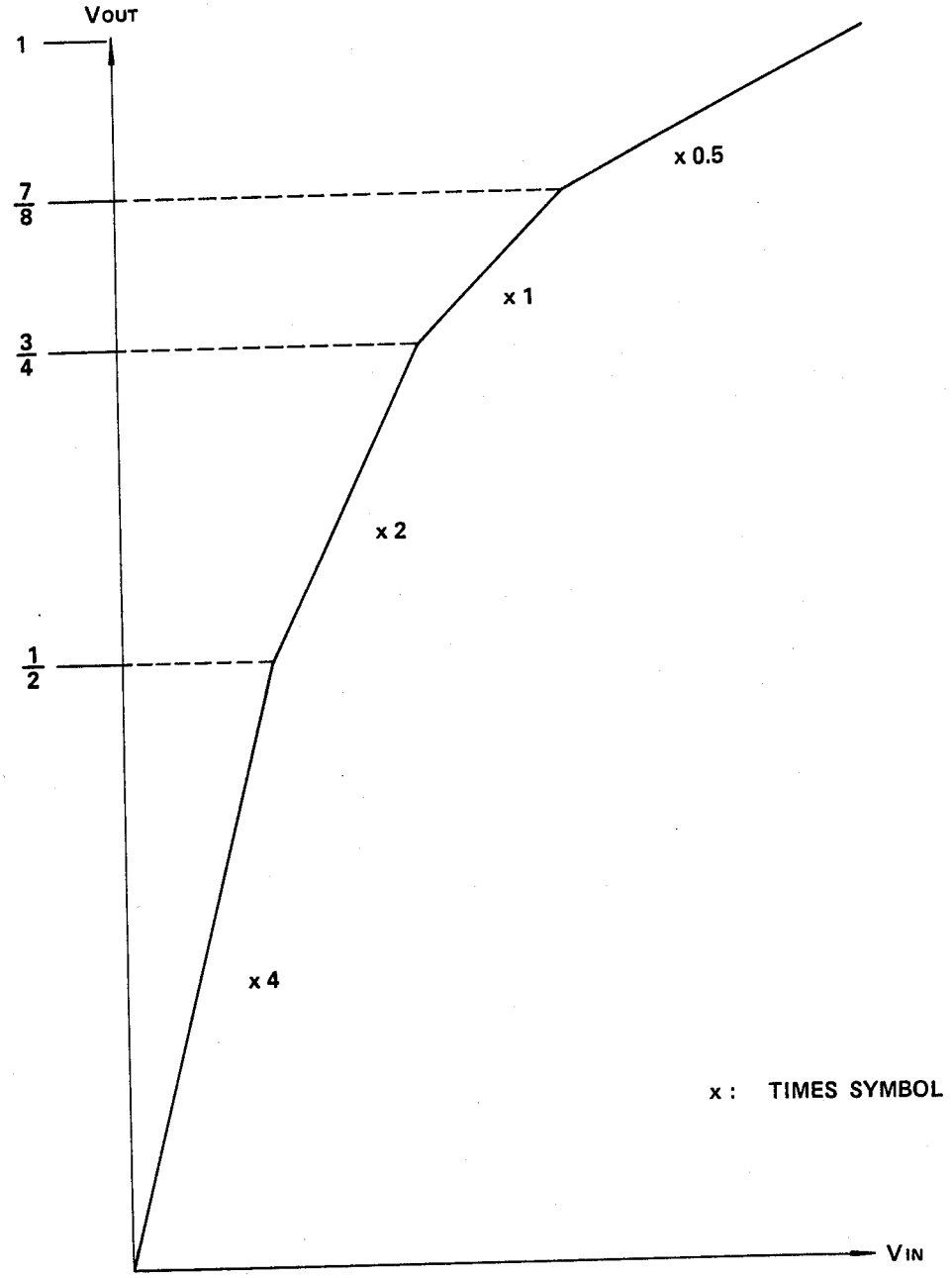
FIG. 5 is a graph for explaining characteristics of a log converter in FIG. 4.

FIG. 5 is a graph of characteristics showing the relationship between input voltage VIN and output voltage VOUT in log converter 7 arranged as shown in FIG. 4.

Figure 6:
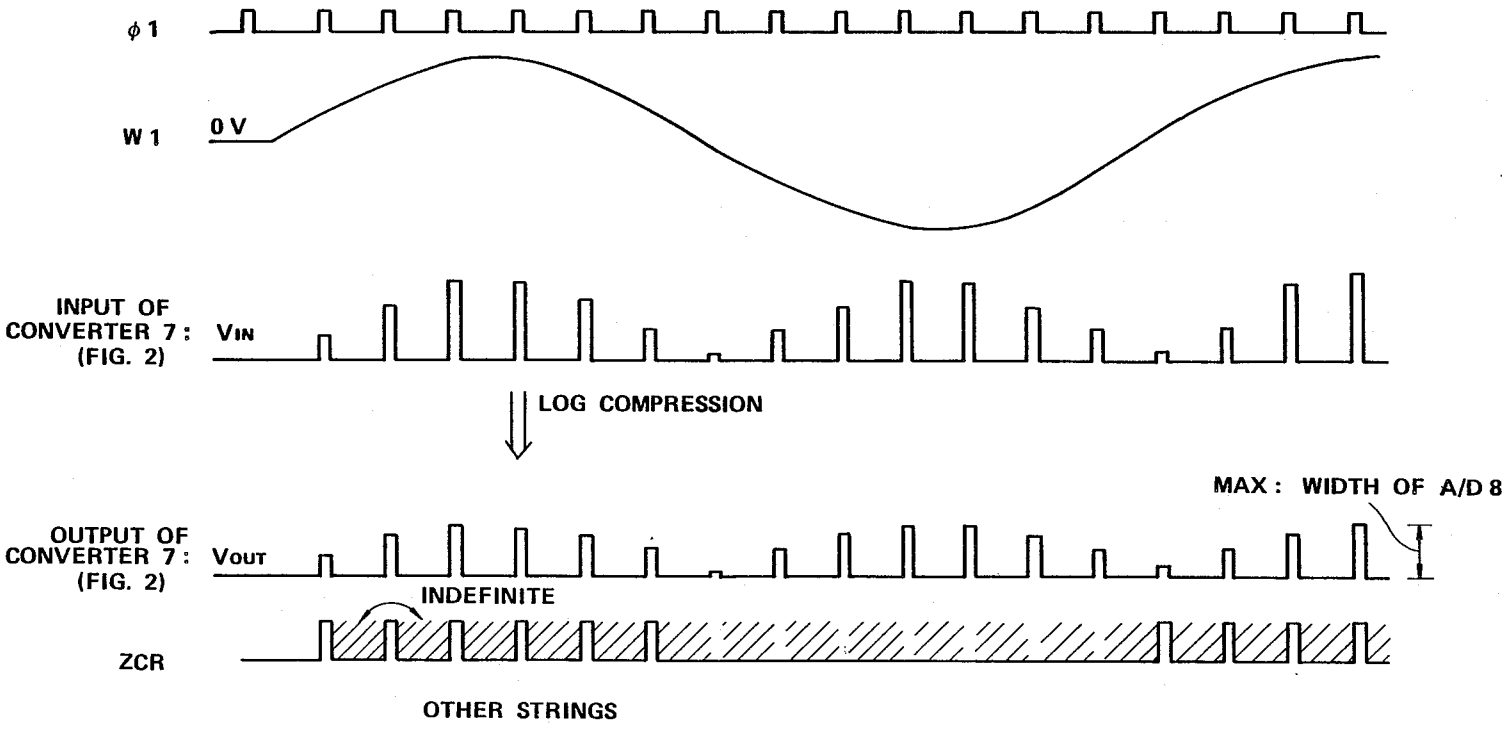
FIG. 6 is a timing chart for explaining the operation of the pitch extraction analog circuit shown in FIGS. 2A and 2B.

FIG. 6 is a timing chart showing sequential pulse $\phi$1, waveform output W1, input voltage VIN of log converter 7, output voltage VOUT, and serial zero-crossing signal ZCR in the arrangement of FIGS. 2A and 2B when the first string is picked. As is apparent from FIG. 6, data is log-compressed by log converter 7 to reduce the number of bits.

Figure 7A:
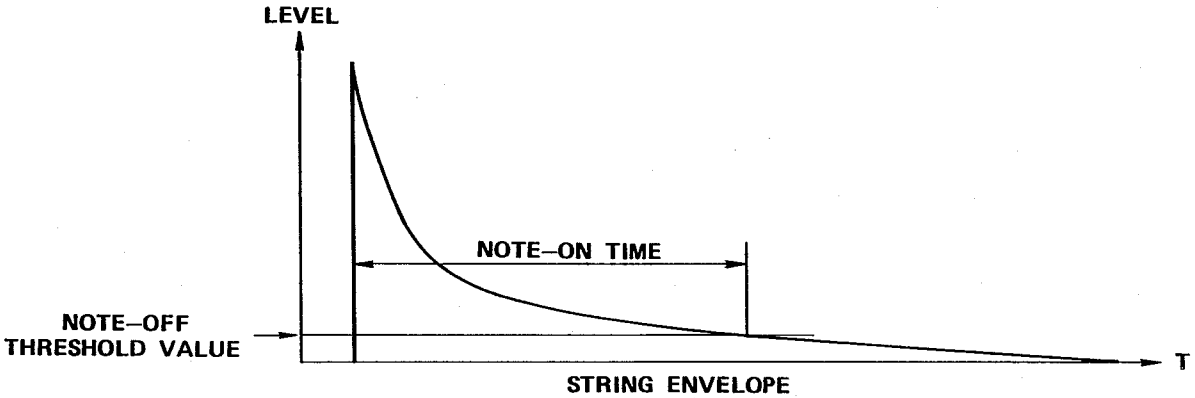
FIGS. 7(*a*) and 7(*b*) are graphs for explaining the function of the log converter shown in FIG. 4.
Figure 7B:
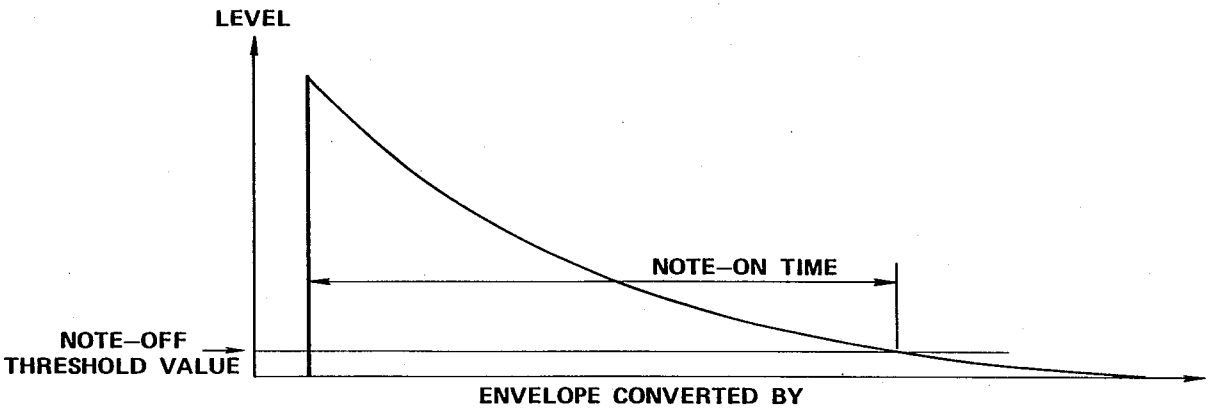

FIGS. 7(*a*) and 7(*a*) show string vibration envelopes before and after conversion in log converter 7. When the string vibration envelope shown in FIG. 7(*a*) is input to log converter 7, the envelope shown in FIG. 7(*b*) can be obtained. Attention should be paid for a note-on time. When the waveform shown in FIG. 7(*a*) is converted by A/D converter 8 to obtain a note-off region having a value below a given threshold value, the note-on time is short. However, when a note-off operation is performed with the threshold value after the log conversion, as shown in FIG. 7(*b*), the note-on time can be prolonged. Therefore, tone generation control can cope with an abrupt attenuation in string vibration in this embodiment.

Log converter 7 is not arranged in pitch extraction digital circuit PD, i.e., log conversion is not performed in the digital circuit. Log converter 7 is arranged in pitch extraction analog circuit PA to perform log conversion in the analog circuit due to the following reason. For example, assume that A/D converter 8 comprises an 8-bit converter and a note-off threshold value in FIG. 7(*b*) is 3. In order to prolong the note-on time in FIG. 7(*a*) as in FIG. 7(*b*), a threshold value must be set to be $\frac{3}{4}=0.75$. This threshold value cannot be set without replacing the A/D converter. It is possible to perform the above setting if a 10-bit converter having the number of bits larger than the currently used converter by 2 bits is used. However, a circuit arrangement becomes expensive by an increase in cost of the converter.

FIG. 8 is a schematic block diagram of pitch extraction digital circuit PD in FIG. 1. Pitch extraction digital circuit PD comprises peak detector PEDT for receiving serial zero-crossing signal ZCR and detecting MAX and MIN peaks, time constant conversion control circuit TCC for converting a time constant of peak detector PEDT, zero-crossing time receiving circuit ZTS, peak value receiving circuit PVS, timing generator TG for generating various timing signals, e.g., sequential pulses $\phi$1 to $\phi$6, and timing signals ADCK, Q5, M05, and MC. These components will be described in detail below.

Figure 9A:
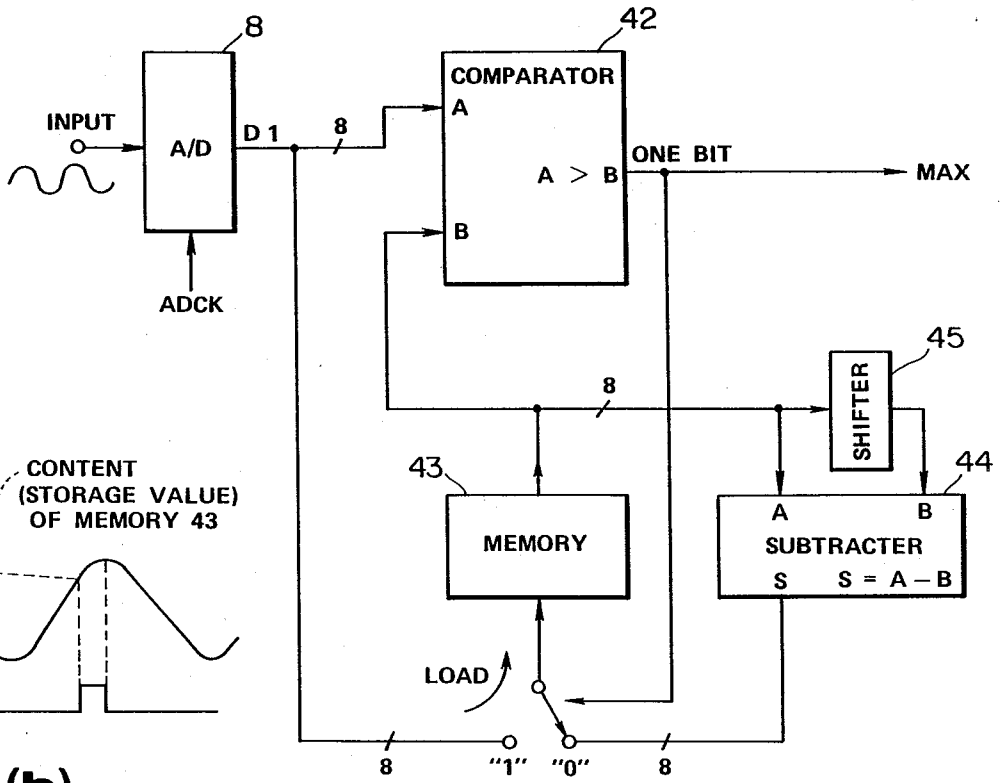
FIGS. 9(*a*) and 9(*b*) are a diagram and a waveform chart, respectively, of a peak detector shown in FIG. 8.
Figure 9B:
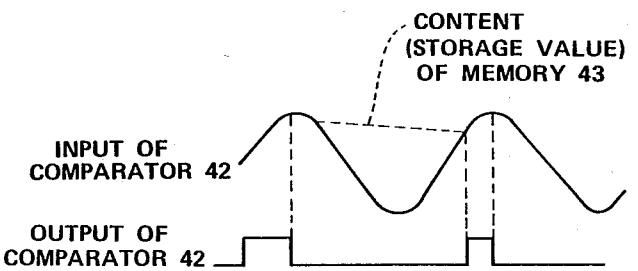

FIGS. 9(*a*) and 9(*b*) are a schematic diagram and a waveform chart, respectively, for explaining peak detector PEDT. More specifically, FIG. (*a*) is a circuit diagram of a positive side of the vibrations of one string. In principle, 12 circuits in FIG. 9(*a*) are required. In practice, however, 12 circuits need not be arranged to process vibrations of a plurality of strings according to a time-divisional technique. This technique will be described in detail later with reference to FIG. 10. A log-converted waveform signal from log converter 7 in pitch extraction analog circuit PA is input to A/D converter 8 and is converted into digital output D1 every time A/D conversion clock signal ADCK from timing generator TG in FIG. 8 is input. Digital output D1 is input to one input terminal of comparator 42 (this input value is defined as A). A/D converter 8 is identical with the one shown in FIG. 2. Its characteristics are also illustrated in FIG. (*a*) for illustrative convenience.

A storage value from memory 43 is input to the other input terminal B of comparator 42 (this value is defined as B). If A>B, comparator 42 outputs a signal of "H" level, i.e., logic "1". Otherwise, comparator 42 outputs a signal of "L" level, i.e., logic "0". Memory 43 can store an output from A/D converter 8 or an output from subtracter 44. Output selection is performed by data selection switch 46. That is, if the output from comparator 42 is set at logic "1", switch 46 is switched to the "1" side, so that the output from A/D converter 8 is loaded in memory 43. However, if the output from comparator 46 is set at logic "0", switch 46 is switched to the "0" side, so that the output from subtracter 44 is loaded in memory 43.

The storage value from memory 43 is directly input to one input terminal A of subtracter 44. A value obtained by multiplying the storage value of memory 43 with 1/n through, e.g., shifter 45 is input to the other input terminal B of subtracter 44. Subtracter 44 calculates a difference (A−B), and the difference appears at output terminal S. Shifter 45 subtracts, e.g., a 1/256 value of the storage value from the storage value of memory 43. Therefore, subtracter 44 performs the following calculation:

$$S=A-B=A-(1/256)\cdot A.$$

Value B may be a constant independently of value A. However, according to the above equation, S is exponentially changed, and good characteristics can be obtained.

the above arrangement, when the waveform signal (input to comparator 42) shown in FIG. 9(*b*) is input to comparator 42, a MAX peak detection signal shown in FIG. 9(*b*) is output from comparator 42. That is, when the out.put from A/D converter 8 which serves as an input to comparator 42 rises, the output from comparator 42 rises and goes to logic "1". When the input to comparator 42 is smaller than the storage value of memory 43, the output from comparator 42 falls and goes to logic "0". An output from A/D converter 8 advances to a negative half wave period and then toward the positive side. When the output from A/D converter 8 reaches the storage value of memory 43, the output from comparator 42 rises and goes to logic "1". When the output from A/D converter 8 reaches the MAX peak, the output from comparator 42 falls and goes to logic "0". In this manner, the MAX peak of comparator 42 can be detected. A divider may be used in place of shifter 45.

Figure 18A:
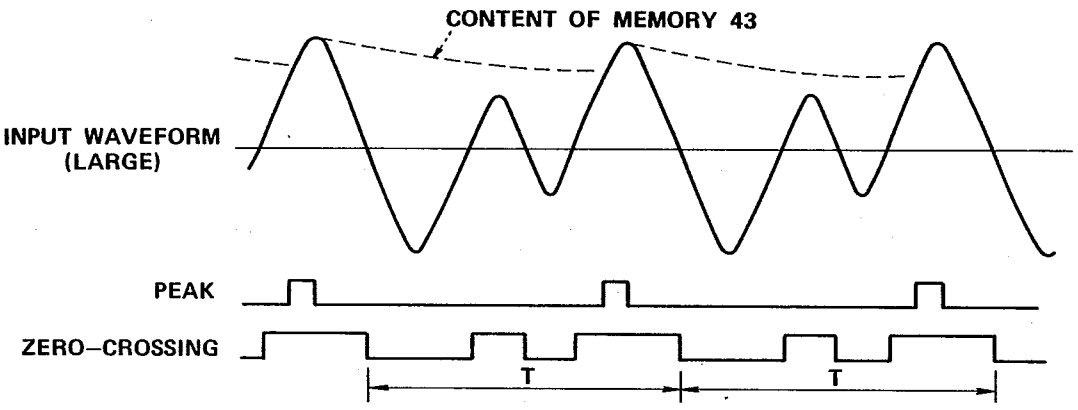
FIGS. 18(*a*) and 18(*b*) are timing charts for explaining an operation of the embodiment in response to an input waveform signal.
Figure 18B:
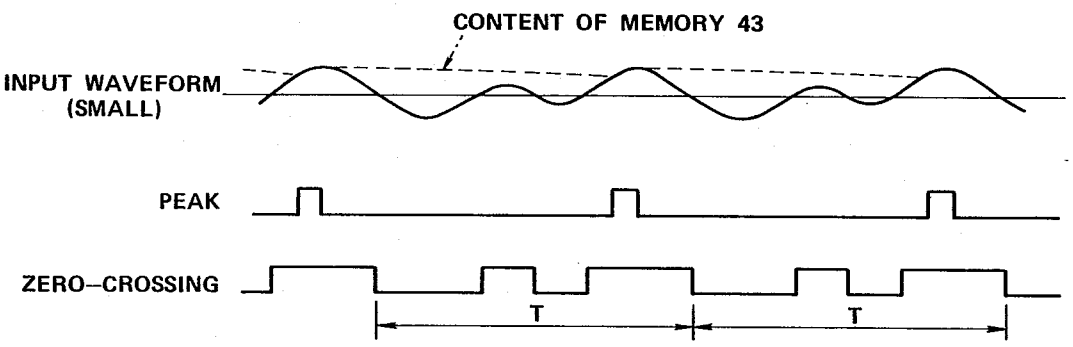

FIGS. 18(*a*) and 18(*b*) are timing charts for explaining the operation of the circuit in FIG. 9. More specifically, FIG. 18(*a*) shows the relationship between the peak and zero-crossing when the input waveform signal is large. FIG. 18(*b*) shows the relationship between the peak and zero-crossing when the input waveform signal is small. Peak and zero-crossing detection can be performed even if the magnitude of the input waveform signal is the one shown in FIG. 18(*a*) or 18(*b*).

FIG. 18(*a*) shows a waveform including second harmonic overtones. According to this embodiment, a time interval between zero-crossings immediately after the peaks can be measured, as will be apparent from a subsequent description. Therefore, the harmonic overtones are eliminated and period detection can be performed (T in FIG. 18(*a*) is the period).

Even in the waveform shown in FIG. 18(*b*), a reduction rate of memory 43 must be taken into consideration in order to eliminate harmonic overtones as in FIG. 18 (*a*). If the input waveform is large, processing must be fast; and if the input waveform is small, processing must be slow. In this embodiment, by attenuating the contents of memory 43 according to an exponential curve, good harmonic overtone elimination can be performed in both the cases in FIGS. 18(*a*) and 18(*b*).

Figure 10:
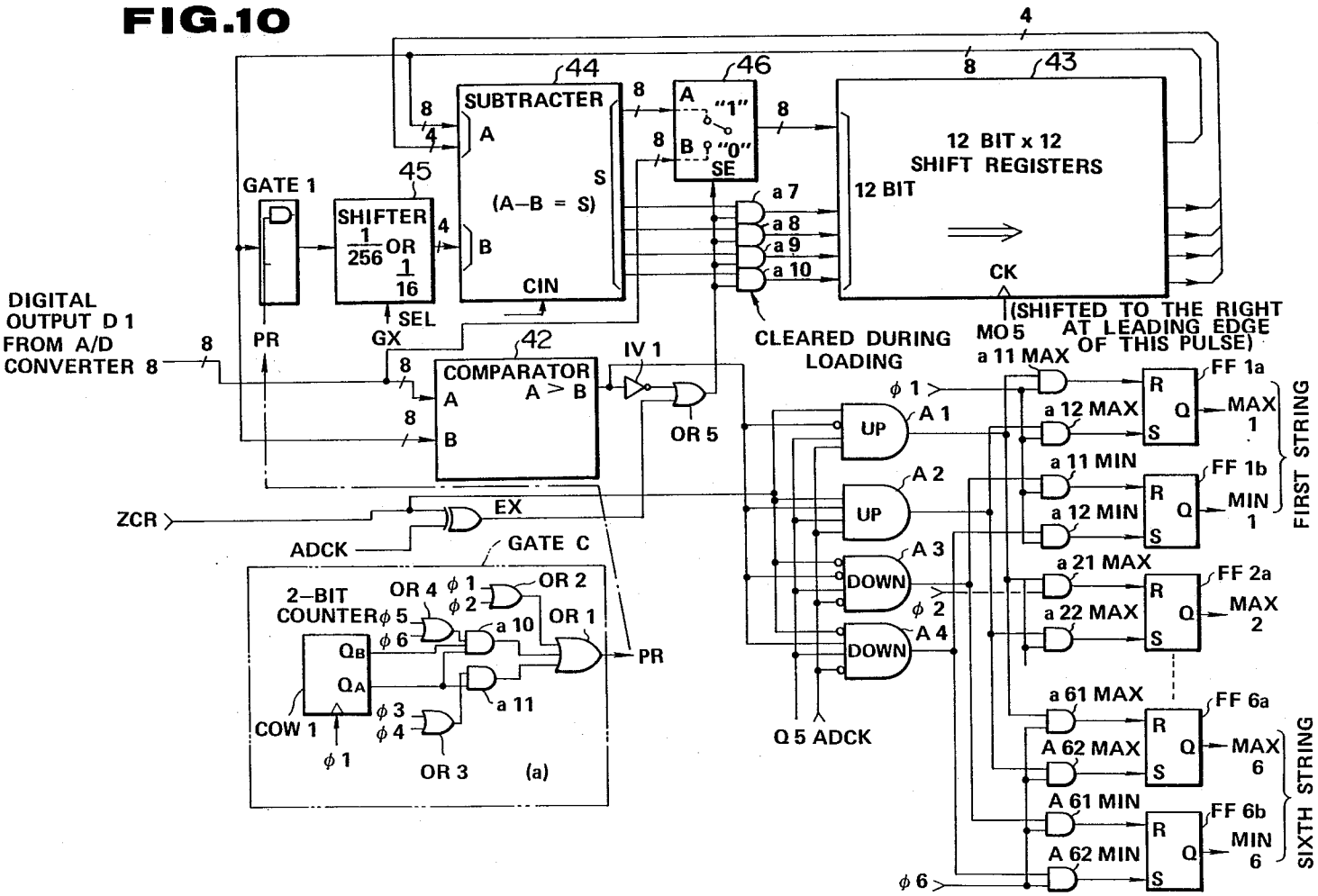
FIG. 10 is a diagram showing a detailed arrangement of the peak detector.

FIG. 10 shows a detailed circuit arrangement of peak detector PEDT shown in FIG. 8. A storage value stored in memory 43, e.g., twelve 12-bit shift registers (6[strings]×2[(maximum (positive) or minimum (negative) peak holding)]=12) is input to gate GATEI, and gate GATEI is enabled or disabled in response to control signal PR from gate control circuit GATEC. An output from gate GATEl is input to shifter 45, and an output from shifter 45 is input to one input terminal of subtracter 44. The storage value from memory 43 is directly input to the other input terminal of subtracter 44. Timing signal M05 from timing generator TG in FIG. 8 is input to clock terminal CK of memory 43. The contents of memory 43 are shifted to the right in response to the leading edge of timing signal M05. Shifter 45 performs shifting at a rate of, e.g., 1/256 (8-bit shifting) or 1/16 (4-bit shifting). Switching between 8- and 4-bit shifting is controlled by time constant change signal GX.

Figure 11:
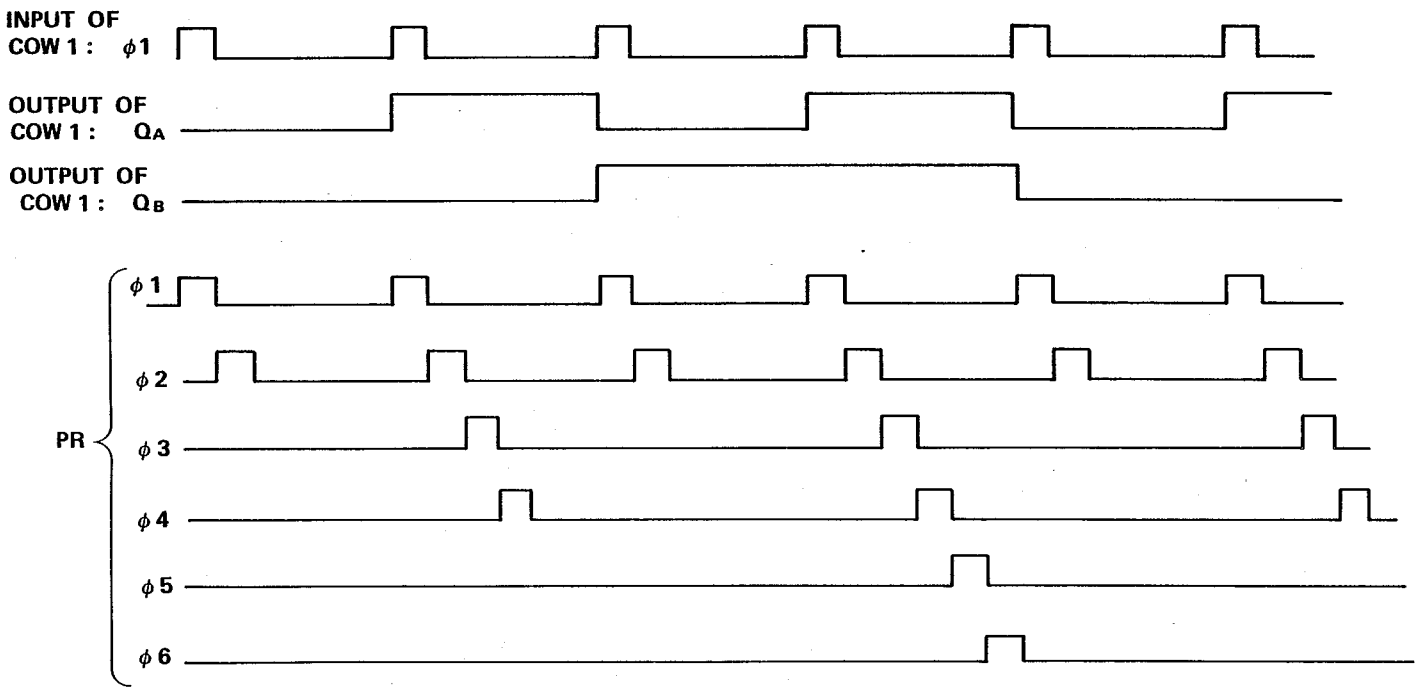
FIG. 11 is a timing chart showing the operation of the circuit in FIG. 10.

Gate control circuit GATEC comprises 2-bit counter COW1, OR gates OR1 to OR4, and AND gates a10 and all. Since sequential pulse $\phi$1 is input to the input terminal of counter COW1, sequential pulses $\phi$1 and $\phi$2 input to OR gate OR2 are directly gated therethrough and are supplied as control signal PR, as shown in the timing chart in FIG. 11. Similarly, since pulses $\phi$3 and $\phi$4 are output through AND gate all, these pulses are output as one control signal PR per two cycles, i.e., during the period in which the QA output is set at logic "1". Similarly, pulses $\phi$5 and $\phi$6 are output as one control signal PR per four cycles, i.e., when QA and QB outputs are simultaneously set at logic "1". This control signal serves as a gate enable signal for gate GATE1. A subtraction operation for the first and second strings is performed by subtracter 44 every cycle. A subtraction operation for the third and fourth strings is performed every other cycle. A subtraction operation for the fifth and sixth strings is performed in every fourth cycle due to the following reason. The string vibration of the high-pitch strings (i.e., the first string side) tends to be abruptly attenuated. The string vibration of the low-pitch strings (i.e., sixth string side) tends to be slowly attenuated.

The reduction rate of the first- and second-string contents in memory 43 is large, while the reduction rate of the fifth- and sixth-string contents in memory 43 is small. The reduction rate of the third- and fourth-string contents in memory 43 is intermediate. The rate may be changed in units of strings. Alternatively, The change in rate may be performed for string groups, or for a group of first to third strings and a group of fourth to sixth strings. An output from gate GATEl enabled at high level of control signal PR, that is, an output read out from memory 43, is supplied to shifter 45. The shift amount of shifter 45 can be changed by time constant change signal GX, as described above. Subtracter 44 performs the following operations:

If time constant change signal GX is set at logic "0", the following operation is performed:

$$S=R(1-1/256)-1.$$

However, if time constant change signal GX is set at logic "1", the following operation is performed:

$$S=R(1-1/16)-1.$$

Subtracter 44 includes carry-in input terminal CIN. Therefore, an output can be reduced even if the other input terminal, i.e., the B input side, of subtracter 44 is set at logic "0".

If the operation of subtracter 44 is strictly synchronized with control signal PR from gate control circuit GATEC, control signal PR is supplied to carry-in input terminal CIN. With this arrangement, "−1" calculations in the above equations are performed whenever the content of memory 43 is supplied to subtracter 44 through gate GATEI and shifter 45.

When a signal of logic "1" is supplied from OR gate OR5, the upper eight bits of an output from subtracter 44 are input to memory 43 through data selection switch 46. The lower four bits are input to memory 43 through AND gates a7 to a10. When a signal of logic "0" is supplied from OR gate OR5, new digital output D1 from A/D converter 8 is supplied to memory 43 through data selection switch 46 due to the following reason. An output from OR gate OR5 is input to input terminal SE of data selection switch 46 and AND gates a7 to a10.

Digital output D1 from A/D converter 8 is input to one input terminal A of comparator 42. A storage value (upper eight bits) from memory 43 is input to the other input terminal B of comparator 42. Digital output D1 input to one input terminal A of comparator 44 is also input to the other input terminal of data selection switch 46. An output from comparator 42 is input to one input terminal of OR gate OR5 through inverter IVl. An output from exclusive OR gate EX is input to the other input terminal of OR gate OR5. Serial zero-crossing signal ZCR from pitch extraction analog circuit PA and AD conversion timing signal ADCK from timing generator TG are input to the input terminals of exclusive OR gate EX. Therefore, when signal ZCR coincides with signal ADCK, an output from exclusive OR gate EX is set at logic "0".

When the output from exclusive OR gate EX is set at logic "0", i.e., when signal ZCR coincides with signal ADCK a new digital output D1 exceeds a storage value of memory 43, an output from OR gate OR5 is set at logic "0". As described above, new digital output D1 is loaded in memory 43 through data selection switch 46 (in this case, lower four bits are all "0"s) When the output from exclusive OR gate EX is set at logic "1", i.e., when signal ZCR does not coincide with signal ADCK, an output from OR gate OR5 is set at logic "1". The output from subtracter 44 is input to memory 43, but new digital output D1 is not input thereto. Similarly, even if signal ZCR coincides with signal ADCK, if condition A<B is established in comparator 42, an output from OR gate OR5 is set at logic "1 ". Therefore, new digital output D1 is not supplied to memory 43.

Serial zero-crossing signal ZCR, the output from comparator 42, and timing signals Q5 and ADCK from timing generator TG are respectively input to AND gates Al to A4 in the serial-to-parallel converter. Outputs from AND gates Al to A4 and sequential pulses $\phi$1, $\phi$2,... $\phi$6 from timing generator TG are supplied to AND gates a11max, a12max,... a62max and a11min, a12min,... a62min. Outputs from AND gates a11max, a11min,... a62min are input to flip-flops FFla, FFlb,...

FF6b and converted into parallel peak signals MAXI and MINI (I=1 to 6) When A/D conversion clock signal ADCK is set at logic "1", outputs from up (positive) AND gates Al and A2 are set at logic "1". However, if A/D conversion clock signal ADCK is set at logic "0", outputs from down (negative) AND gates A3 and A4 are set at logic "1".

When serial zero-crossing signal ZCR is set at logic "1" and the output from comparator 42 is set at logic "0", AND gate A1 supplies a "1" output to AND gate aI1max (I=1 to 6) to set outputs of MAXI (I=1 to 6) to be low level while A/D conversion clock signals ADCK and Q5 are set at logic "1". Therefore, one of flip-flops FF1*a* to FF6*a* is reset.

Similarly, AND gate A2 supplies a "1" output to AND gates aI2max (I=1 to 6) to set outputs of MAXI (I=1 to 6) to be high level when serial zero-crossing signal ZCR is set at logic "1" and the output from comparator 42 is set at logic "1" while A/D conversion clock signal ADCK and timing signal Q5 are kept at logic "1". Therefore, one of flip-flops FF1ato FF6*a* is reset.

AND gate A3 supplies a "1" output to AND gates aI2min (I=1 to 6) to set MINI (I=1 to 6) to be low level when serial zero-crossing signal ZCR is set at logic "0" and the output from comparator 42 is set at logic "0" while A/D conversion clock signal ADCK is set at logic "0" and timing signal Q5 is set at logic "1". One of flip-flops FF1*b* to FF6*b* is reset.

AND gate A4 supplies a "1" output to AND gates aI2min (I=1 to 6) to set MINI to (I=1 to 6) to be high level when serial zero-crossing signal ZCR is set at logic "0" and the output from comparator 42 is set at logic "1" while A/D conversion clock signal ADCK is set at logic "0" and timing signal Q5 is set at logic "1". One of flip-flops FF1*b* to FF6*b* is reset.

Figure 15:
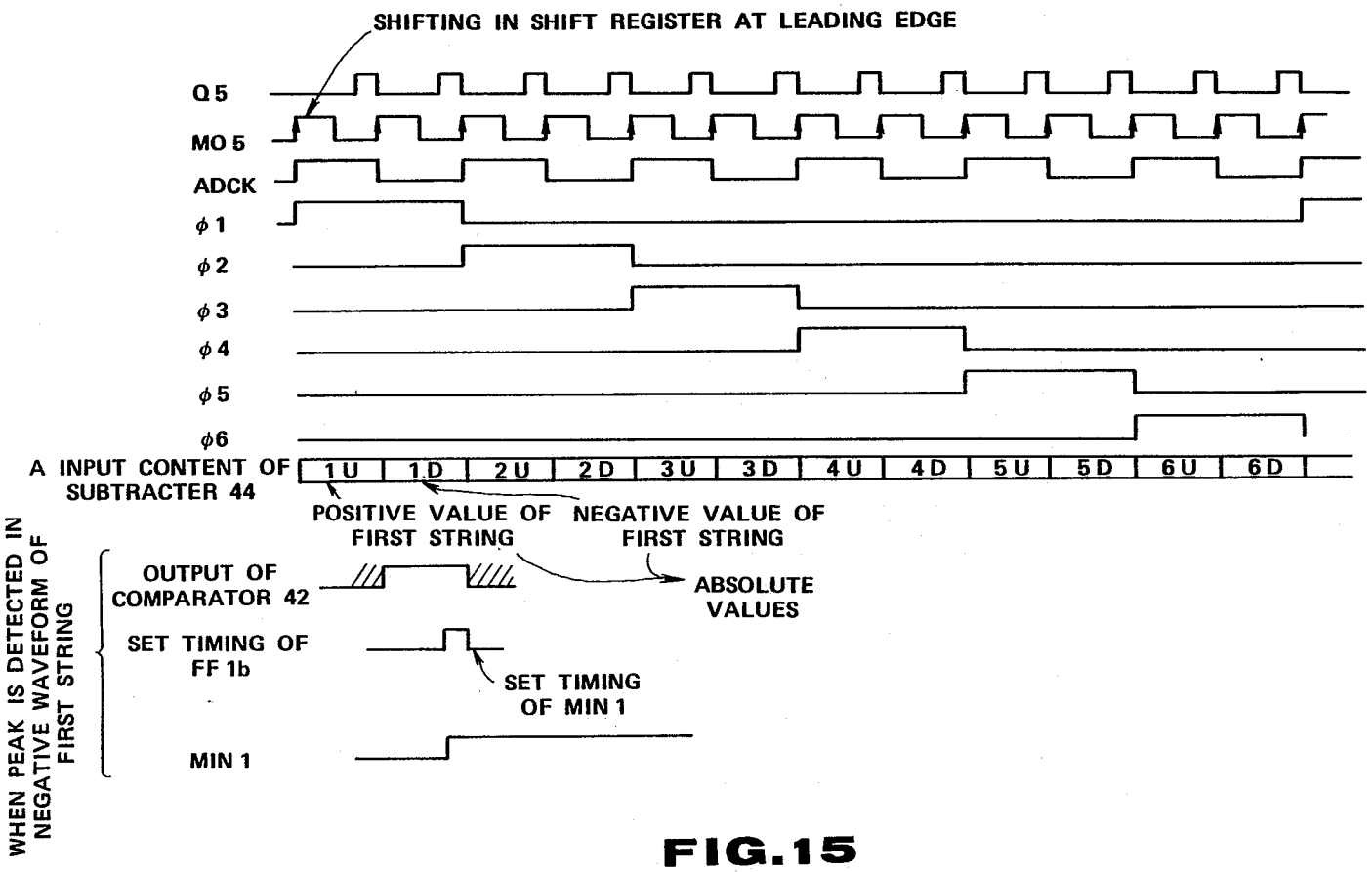
FIG. 15 is a timing chart for explaining the operation of the circuit shown in FIG. 10.

FIG. 15 is a timing chart for explaining the operation of FIG. 10, showing the case in which a peak signal of MINI is output from flip-flop FF1*b*. A storage value stored in memory 43 is input to the A input terminal of subtracter 44 at the leading edge of timing signal M05. In this case, these storage value are input in an order of IU (positive sideoof the first string), ID (negative side of the first string),... 6D (negative side of the sixth string). Values obtained by bit-shifting the storage value of memory 43 by shifter 45 at a predetermined rate after gate GATE1 is enabled in accordance with control signal PR obtained by sequential pulses $\phi$1 to $\phi$6 are input to the B input terminal of subtracter 44. The output from comparator 42 is set at logic "1" only when digital output D1 from A/D converter 8 is larger than the storage value of memory 43 input to the A input terminal of subtracter 44. Flip-flop FF1b is set due to generation of a set timing signal obtained when timing signal Q5 is set at logic "1" and A/D conversion clock signal ADCK is set at logic "". In this case, the MIN1 peak signal appears at output terminal Q of flip-flop FF1*b*. Other flip-flops FF1*a*, FF2*a* to FF6*a*, and FF2*b* to FF6*b* are operated in the same manner as in flip-flop FF1*b*.

MAX1 to MAX6 peak signals as parallel signals are output from flip-flops FF1*a* to FF6*a*, and MIN1 to MIN6 peak signals a parallel signals are output from flipflops FF1*b* to FF*6*.

Figure 12:
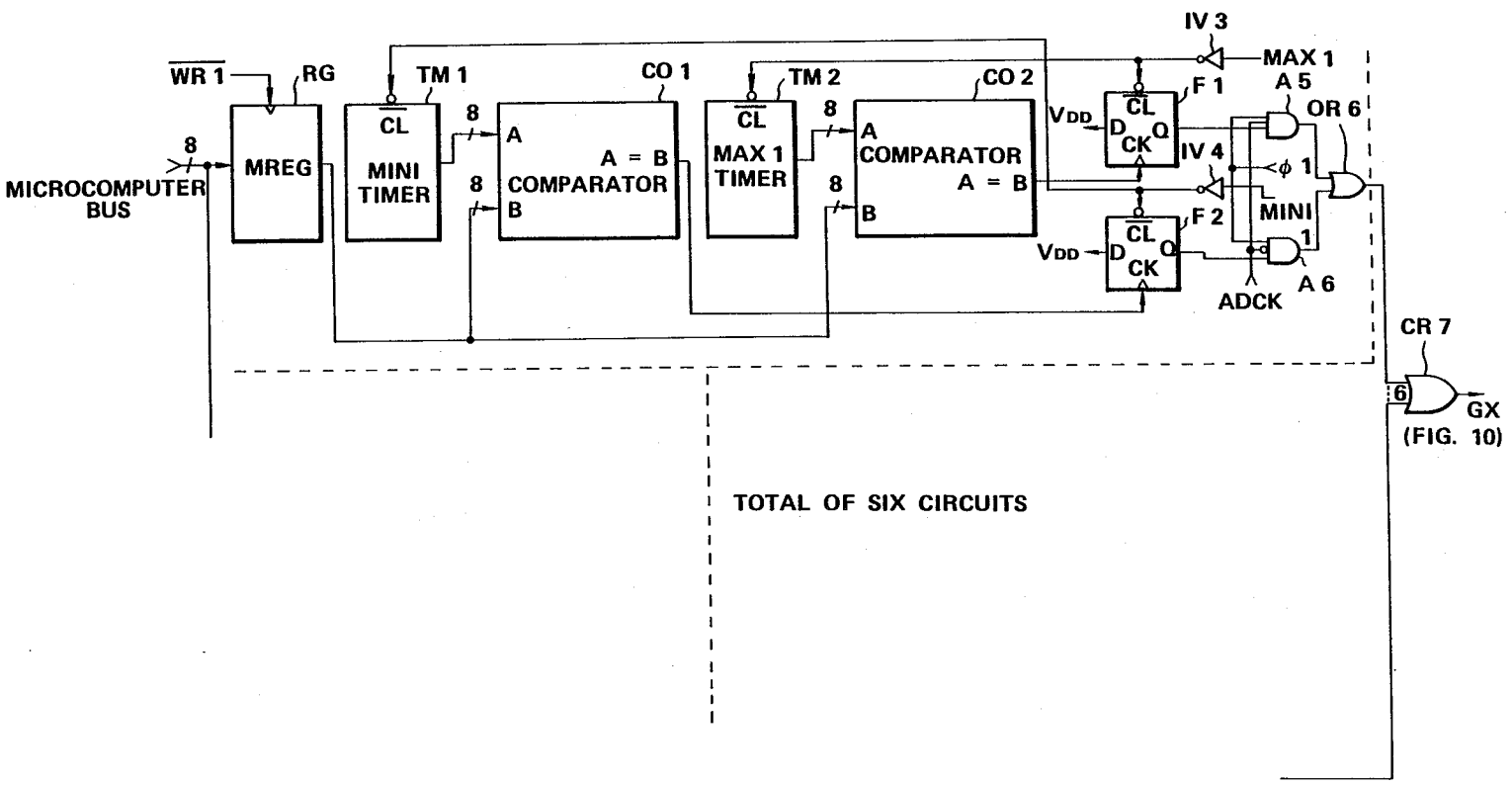
FIG. 12 is a diagram showing a detailed arrangement of a time constant conversion control circuit in FIG. 8.

FIG. 12 is a block diagram of time constant conversion control circuit TCC (FIG. 8) constituting pitch extraction digital circuit PD (FIG. 1). This circuit arrangement represents a circuit portion corresponding to the first string. In practice, six identical circuits are used for the six strings. When write signal WRl is input to register (MREG) RG, data from microcomputer MCP is written therein. In this case, waveform vibrations must be immediately detected in the initial duration of the string vibrations. For that reason, tone period data corresponding to the highest fret of the string is written in the register RG during the note-off time. When the string vibration is detected, the open string period data of the string, i.e., the lowest tone period, data of the string is written in the register RG in order not to pick up harmonic overtones. When the vibration period of the picked string is detected, the corresponding period data is written in the register RG.

MIN1 (FIG. 16) from peak detector PEDT is input to clear terminal CL of MINl timer TMI through inverter IV4. MAX1 (FIG. 16) from peak detector PEDT is input to clear terminal CL of MAX timer TM2 through inverter IV3. Timers TMl and TM2 are cleared when MIN and MAX are set at logic "1". Outputs from timers TM1 and TM2 are input to the A input terminals of comparators CO1 and C02, respectively, and compared with an output from register RG. If inputs at the A and B input terminals coincide with each other, signals output from comparators CO1 and C02 are input to the CK terminals of D flip-flops F2 and Fl, respectively. Outputs from inverters IV4 and IV3 are input to the CL terminals of flip-flops F2 and F1, respectively. Flip-flops F2 and Fl are cleared when the MINl and MAXl peak signals are set at logic "1". Outputs from flip-flops Fl and F2 are input to the first input terminals of 3-input AND gates A5 and A6, respectively. A/D conversion clock signal ADCK is input to the second input terminals of AND gates A5 and A6. Sequential pulse $\phi$1 is input to the third input terminals of AND gates A5 and A6. Outputs from AND gates A5 and A6 are input to OR gate OR6. An output from 0R gate OR6 is input to OR gate OR7. As shown in FIG. 12, A/D conversion clock signal ADCK is directly input to AND gate A5, and an inverted signal thereof is input to AND gate A6.

Figure 16:
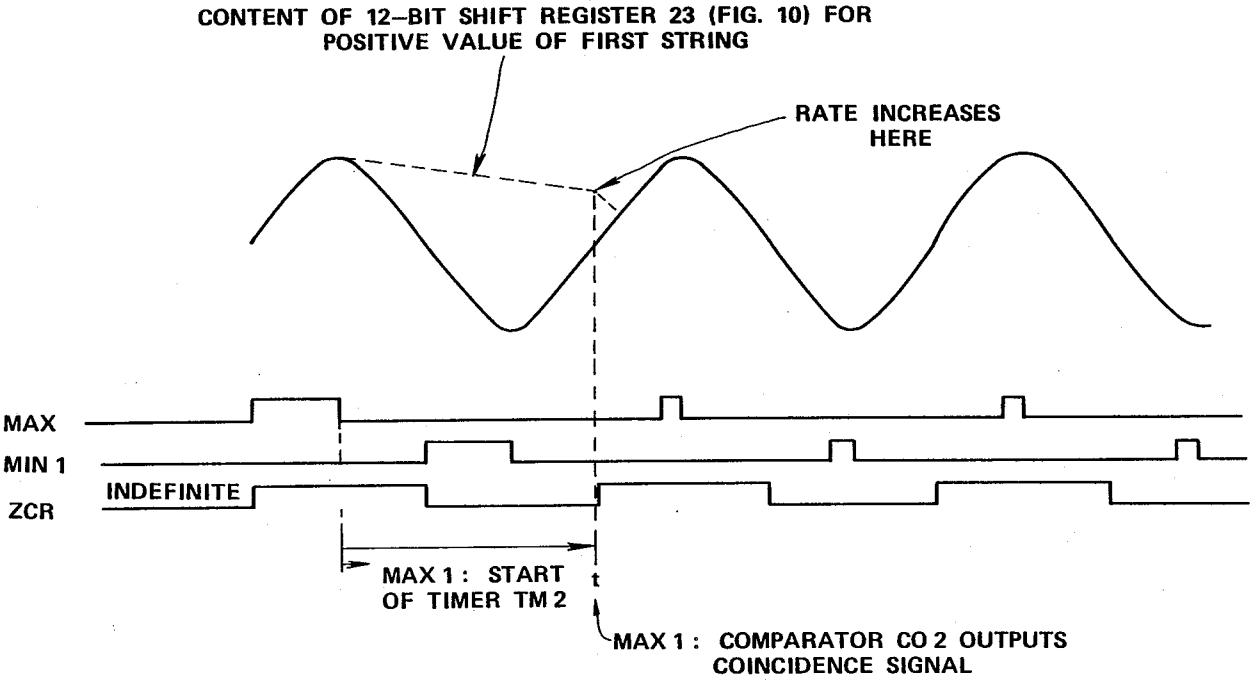
FIG. 16 is a timing chart for explaining the operation of the time constant conversion control circuit in FIG. 12.

In this circuit, if A/D conversion clock signal ADCK is set at logic "1", an output from flip-flop F1 is set at logic "1", and sequential pulse $\phi$1 is set at logic "1", then a "1" output appears from AND gate A5. If A/D conversion clock signal ADCK is set at logic "0", an output from flip-flop F2 is set at logic "1", and sequential pulse $\phi$1 is set at logic "1", then a "1" output appears from AND gate A6. When one of the "1" outputs from AND gates A5 and A6 appears, an output of logic "1" is output from OR gate OR6. Therefore, time constant change signal GX is output from OR gate OR7. Signal GX is normally set at logic "0". However, signal GX goes high when a time set in register RG has elapsed. By switching the number of stages of shifter 45 shown in FIG. 10, the register contents of memory 43, i.e., the positive or negative peak value of the first string in this case, are damped at high speed (FIG. 16).

Figure 13:
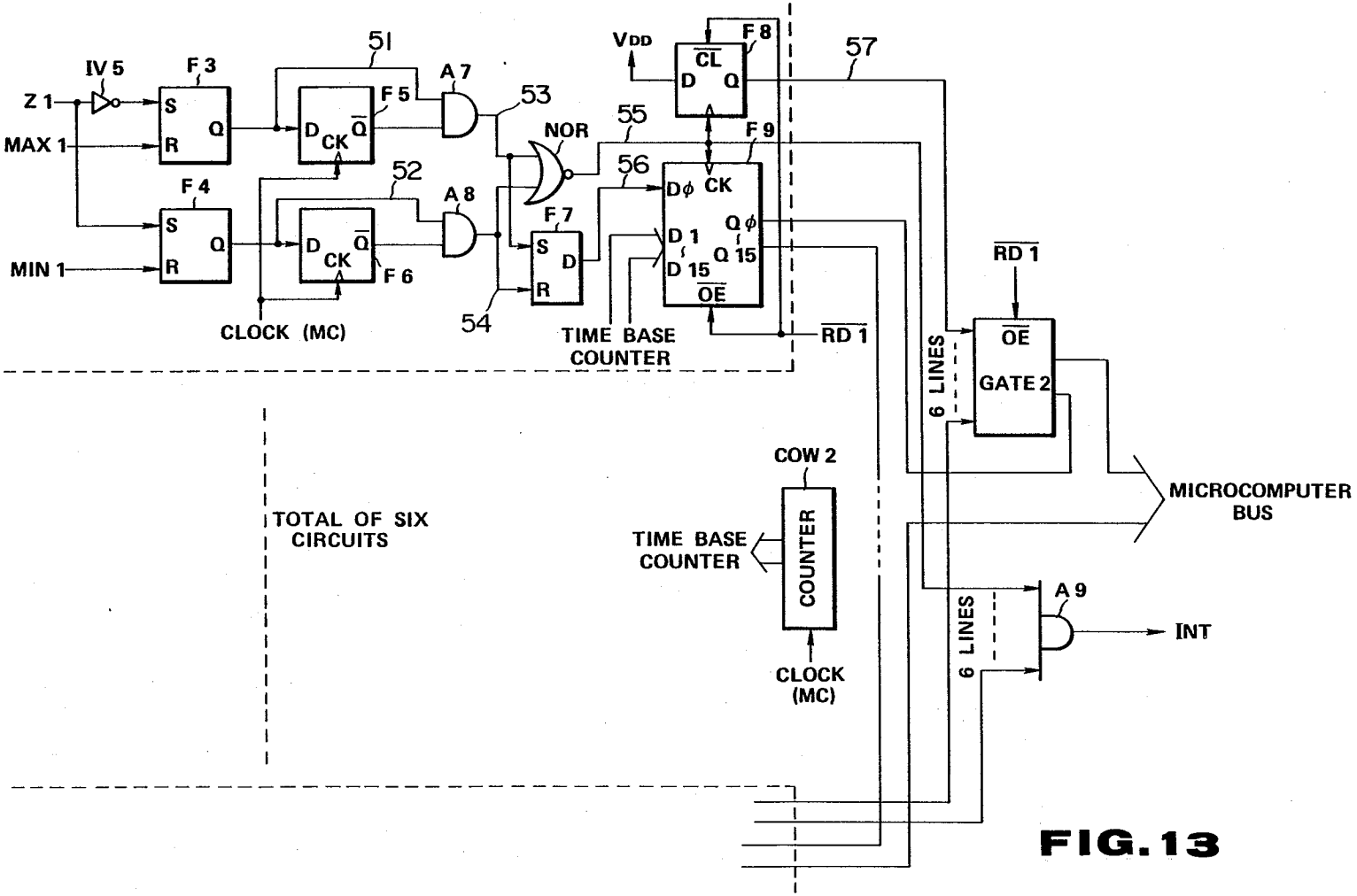
FIG. 13 is a diagram showing a detailed arrangement of a zero-crossing time receiving circuit in FIG. 8.

FIG. 13 is a circuit diagram showing a detailed arrangement of zero-crossing time receiving circuit ZTS (FIG. 8) constituting pitch extraction digital circuit PD (FIG. 1). This circuit arrangement represents a only circuit portion for the first string. MAX1 from peak detector PEDT is input to the R input terminal of R-S flip-flop F3. Zero-crossing signal Z1 of the first string is input to the S input terminal of R-S flip-flop F3 through inverter IV5. An output (51 in FIG. 17) from the Q output terminal of flip-flop F3 is input to the D input terminal of D flip-flop F5. MIN1 from peak detector PEDT is input to the R input terminal of R-S flip-flop F4. Zero-crossing signal Z1 of the first string is input to the S input terminal of flip-flop F4. An output (52 in FIG. 17) from the Q output terminal of flip-flop F4 is input to the D input terminal of D flip-flop F6. The CK terminals of flip-flops F5 and F6 receive clock signal MC from timing generator TG in FIG. 8. Flip-flops F5 and F6 receive input signals from their D input terminals in response to the leading edge of clock signal MC. These input signals appear at the Q output terminals of flip-flops F5 and F6 and are input to the first input terminals of AND gates A7 and A8. The second input terminals of AND gates A7 and A8 receive outputs from the Q output terminals of flip-flop F3 and F4, respectively.

Outputs (53 and 54 in FIG. 17) from AND gates A7 and A8 are input to NOR gate NOR and to the S and R input terminals, respectivey, of R-S flip-flop F7. An output (55 in FIG. 17) from NOR gate NOR is input to the CK terminal of D flip-flop F8 and the CK terminal of D flip-flop F9. An output (56 in FIG. 17) from flip-flop F7 is input to the D0 input terminal of flip-flop F9. Time read signal $\overline{RD1}$ (FIG. 17) from decoder DCD in FIG. 1 is input to the CL terminal of flip-flop F8 and the OE terminal of flip-flop F9. An output from time base counter COW2 is input to the D1 to D15 input terminals of flip-flop F9. Reference voltage VDD is input to the D input terminal of flip-flop F8. The input terminal of gate GATE2 receives an output (57 in FIG. 17) from flip-flop F8 (circuit corresponding to the first string) and outputs from flip-flops (not shown) corresponding to the second to sixth strings. String number read signal $\overline{RD1}$ is input to the OE terminal of gate GATE2. An output from gate GATE2 is input to microcomputer MCP through bus BUS. The input terminals of AND gate A9 receive an output from NOR gate NOR corresponding to the first string and outputs from NOR gates (not shown) corresponding to the second and sixth strings. Therefore, common interrupt signal INT for all the strings is input to microcomputer MCP.

Figure 17:
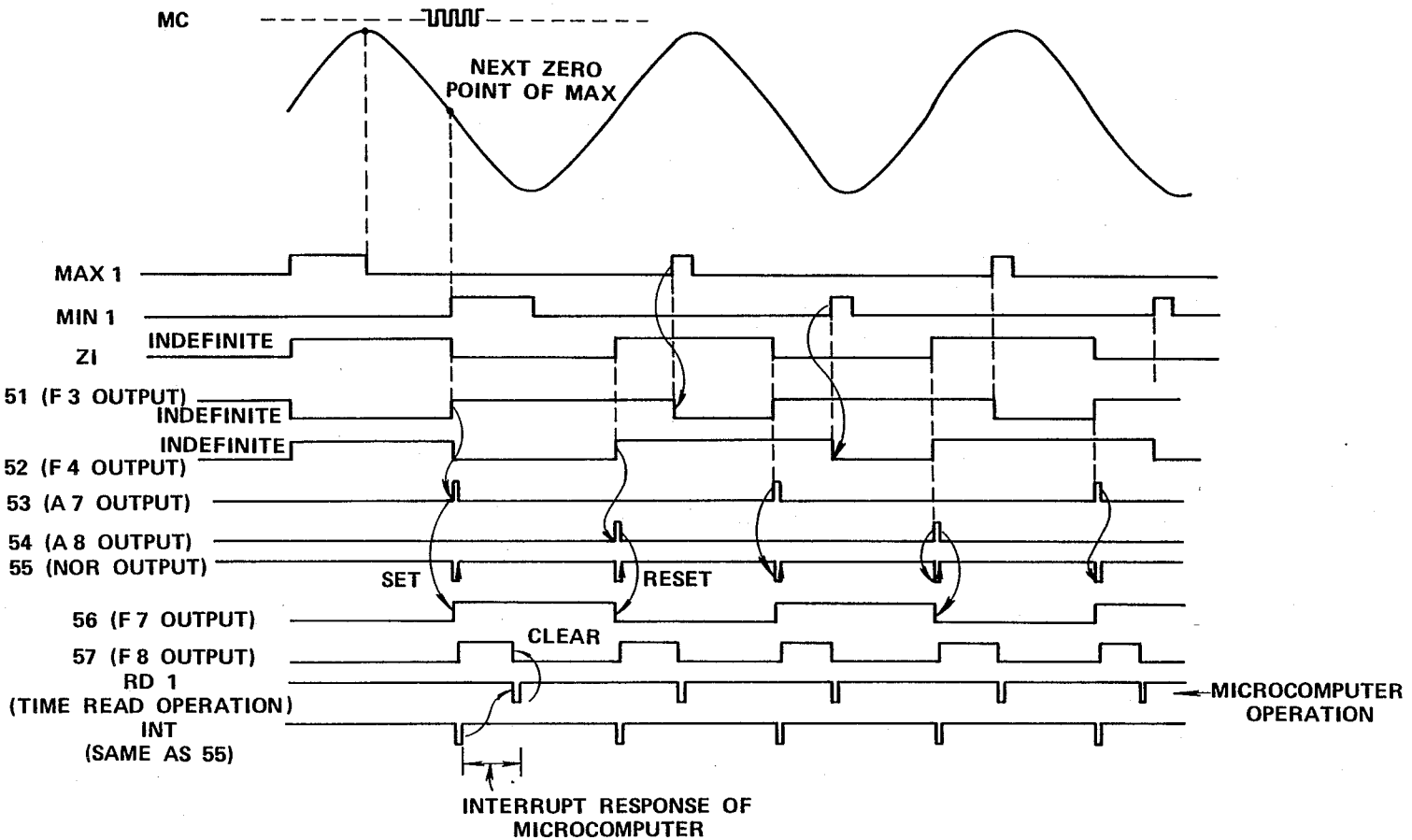
FIG. 17 is a timing chart, for explaining the operation of the cicuit shown in FIG. 13.

FIG. 17 is a timing chart for explaining the operation of zero-crossing time receiving circuit ZTS in FIG. 13. Reference symbol MC denotes a clock signal input to flip-flops F5 and F6 and counter COW2; MAXI and MINI, detection signals from peak detector PEDT; and Z1, a zero-crossing signal for the first string. Reference numeral 51 denotes an output from flip-flop F3; 52, an output from flip-flop F4; 53, an output from AND gate A7; 54, an output from AND gate A8; 55, an output from NOR gate NOR; 56, an output from flip-flop F7; and 57, an output from flip-flop F8. Reference symbol RD1 denotes a time read signal; and INT (the same as 55), an interrupt signal.

Referring to FIGS. 13 and 17, when flip-flop F3 is reset in response to MAXl and zero-crossing signal Z1 goes low and is input to flip-flop F3, output 51 from flip-flop F3 is set at logic "1". At the same time, the output from flip-flop F5 goes low (because clock signal MC is enabled). One-shot pulse output 53 having the same pulse width as that of clock signal MC is output from AND gate A7. Therefore, the next MAXI zero-crossing point to the positive peak determined by MAX1 is detected.

When flip-flop F4 is reset in response to MIN1 and zero-crossing signal Z1 input to flip-flop F4 goes high, output 52 from flip-flop F4 is set at logic "1". At the same time, an output from flip-flop F6 goes low (as clock signal MC is input). One-shot pulse output 54 having the same pulse width as that of clock signal MC is output from AND gate A8. Therefore, the next zero-crossing point to the negative peak determined by MIN1 is detected.

Flip-flop F7 is set in response to an output from AND gate A7. Flip-flop F7 is reset in response to an output from AND gate A8. An output from flip-flop F7 is input to LSB input terminal D0 of flip-flop F9. Therefore, the polarity of the peak (if the peak is positive, the output is "1"; and if the peak is negative, the output is "0") is determined.

NOR gate NOR outputs a "0" output when one of the outputs from AND gates A7 and A8 is set at logic "1". In this case, interrupt signal INT from AND gate A9 is output to microcomputer MCP. Microcomputer MCP supplies string number read signal RDI to gate GATE2 to detect the string number corresponding to the generated interrupt signal INT. Microcomputer MCP detects the string number, and outputs one of time read signals RD1 to RD6 so as to read out the content of flip-flop F9 corresponding to the designated string. At this time, flip-flop F8 is cleared. Time information of the time base counter (i.e., time base counter COW2 in FIG. 13) latched by flip-flop F9 at the zero-crossing is read out and is input to microcomputer MCP through bus BUS. As a result, zero-crossing time (the contents of Ql to Q15 of flip-flop F9) of the designated string number is read out in units of polarities, i.e., positive signal (U) and negative signal (D).

Figure 14:
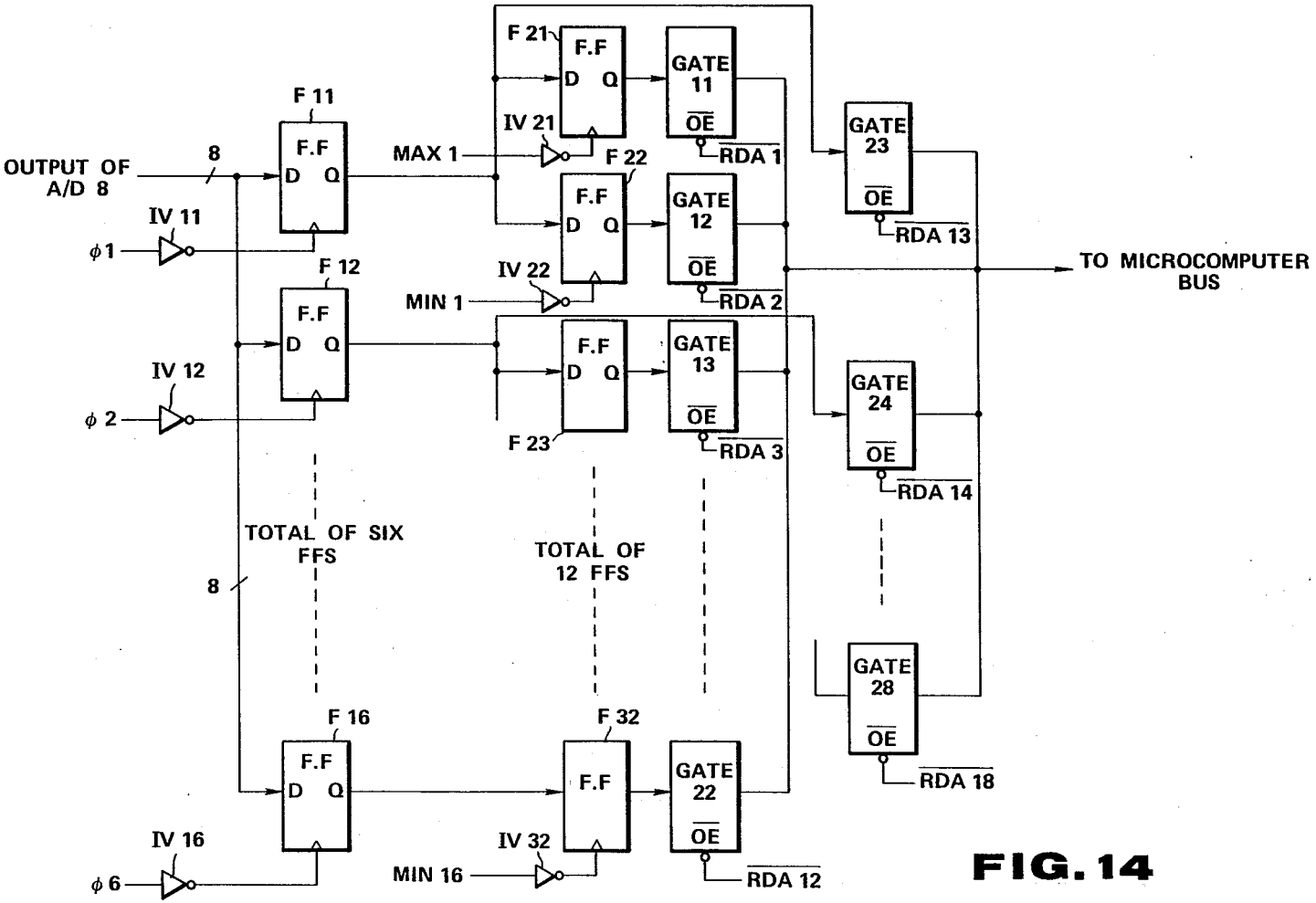
FIG. 14 is a diagram showing a detailed arrangement of a peak value receiving circuit in FIG. 8.

FIG. 14 is a detailed circuit diagram of the peak value receiving circuit (FIG. 8) in pitch extraction digital circuit PD (FIG. 1). Digital output D1 from A/D converter 8 is input to the D input terminals of D flip-flops Fll to F16. If digital output D1 represents an output from the first string, for example, output D1 is input to flip-flop Fll which receives sequential pulse $\phi 1$ from its CK terminal through inverter IVll. An output from the Q output terminal of flip-flop Fll is input to the D input terminals of D flip-flops F21 and F22 and gate GATE23. The OE terminal of gate GATE23 receives read signal $\overline{RDA13}$ from microcomputer MCP. Microcomputer MCP can fetch an instantaneous value of digital output D1 in accordance with its operation.

MAXI from peak detector PEDT is input through inverter IV21 to the CK terminal of flip-flop F21 for receiving the output from flip-flop F11 at a maximum peak timing. In order to read the output from flip-flop Fll at a minimum peak timing, MINI from peak detector PEDT is input to the CK terminal of flip-flop F22 through inverter IV22. Outputs from the Q output terminals of flip-flops F21 and F22 are input to gates GATE11 and GATE12, respectively. The $\overline{OE}$ terminal of gate GATE11 receives MAX value red signal $\overline{RDA1}$ and the $\overline{OE}$ terminal of gate GATE12 receives the MIN value read signal. Outputs from gates GATE11 and GATE12 are input to microcompute MCP through bus BUS. Flip-flops F12 to F16, F23 to F32, gates GATE24 to GATE28, and inverters IV12 to IV32 for other strings are arranged in the same manner as for the first string.

Referring to FIG. 14, when digital output D1 from A/D converter 8 is commonly supplied to flip-flops Fll to F16 and sequential pulses $\phi 1$, $\phi 2$, . . . , $\phi 6$ go low, digital outputs D1 are latched by flip-flops F11 to F16 corresponding to sequential pulses $\phi 1$ to $\phi 6$ at the respective timings. In other words, the waveform signals input time-divisionally in units of strings are set in corresponding flip-flops Fll to F16. Digital output D1 is input to flip-flops F21 to F32 and to gates GATEII to GATE22 or gates GATE23 to GATE28 through flip-flops F21 to F32. When peak value read signals $\overline{RDAI}$ (I=2, 4, . . . 12) are input, negative peak values MIN1 to MIN16 are read out. However, when peak value read signals $\overline{RDAI}$ (I=1, 3, . . . 11) are input, positive peak values MAXl to MAX6 are read out. When peak value read signals $\overline{RDAI}$ (I=3 to 18) are input, the corresponding instantaneous amplitude values are output to microcomputer MCP through bus BUS. Note that the MAX values, the MIN values, and the peak values are used to control tone generation (note-on operation) and muting (note-off or release operation).

Microcomputer MCP reads out the zero-crossing time of a string represented by interrupt signal INT from zero-crossing time receiving circuit ZTS (FIG. 13) whenever microcomputer MCP receives interrupt signal INT from pitch extraction digital circuit PD. Microcomputer MCP also reads out the peak level (this peak level may be positive or negative, so that the polarity of the peak level is designated) immediately preceding interrupt signal INT from peak value receiving circuit PVS (FIG. 14).

The above operations are repeated, and microcomputer MCP can calculate a length of time between the zero-crossings. Therefore, the period of string vibrations can be extracted. Microcomputer MCP can also detect the tone generation and muting timings on the basis of the peak level and the instantaneous level. Therefore, microcomputer MCP can designate the pitch, the volume, the start of tone generation, the start of muting on the basis of the above-mentioned information. The period information can be obtained after the start of tone generation. Therefore, a change in frequency of tone based on an operation such as checking operation or an operation with a tremolo arm after the starting of tone generation can be accurately detected and processed in a real-time basis.

The embodiment described above has the following advantages.

(1) The circuit arrangement for supplying the input waveform signal detected by pitch extraction analog circuit PA and supplied to musical tone generator SOB is constituted by a digital circuit, i.e., pitch extraction digital circuit PD. Therefore, inaccurate input waveform signal peak detection caused by variations in circuit components, degradation of durability, and deteriorations over time as in the conventional apparatus can be prevented.

(2) Peak detector PEDT in pitch extraction digital circuit PD processes the signals according to the time-divisional multiplex scheme, as shown in FIG. 10. Circuits (hardware) respectively corresponding to the strings need not be arranged, thus reducing the number of circuit components and achieving a compact, inexpensive circuit arrangement.

(3)The condition parameters for pitch extraction can be easily changed. For example, the change rate (attenuation rate) of the peak hold level can be easily changed by signal PR or GX. If the same function as in this embodiment is to be obtained by an analog circuit arrangement, different time constant circuits must be used.

(4) The peak timing of the input waveform signal from extraction analog circuit PA can be accurately detected in accordance with an output from comparator 42 in FIG. 9. That is, the value obtained by converting the input waveform signal of pitch extraction analog circuit PA into digital waveform signal A by A/D converter 8 is compared with predetermined digital waveform signal B stored in memory 43, and the peak timing is detected on the basis of the comparison result.

(5) The maximum and minimum peaks of the input waveform signal can be accurately detected in units of strings.

In the above embodiment, the present invention is applied to an electronic guitar. However, the present invention is also applicable to electronic musical instruments of other types or an electronic tuning apparatus. The above-mentioned circuits may be properly modified in accordance with a change in number of strings, and the like.

In the above embodiment, the positive (maximum) and negative (minimum) peaks detected. However, period information can be calculated from the positive or negative peaks, and both the positive and negative peaks need not be detected. It is apparent that response and pitch extraction precision are improved if both peak values are used as compared with detection using one of the peak values.

In the above embodiment, an interrupt signal (INT) is input to microcomputer MCP at the next zero-crossing (immediately) after the peak point. Pitch extraction of the string vibration is performed on the basis of the time information between the zero-crossings. However, pitch extraction is not limited to this technique. A time interval between the corresponding peak points, i.e., between the adjacent maximum peak points or between the adjacent minimum peak points may be calculated to extract the pitch on the basis of the calculated time information. If a peak point and a corresponding peak point or a waveform point corresponding to the detected peak point are detected and the pitch is extracted, the present invention is applicable.

In addition, in the above embodiment, peak levels (MAX and MIN) of the respective peak points are detected, and the detection results are used for volume control. However, only the start of tone generation may be designated, and peak value detection is not essential.

According to the present invention as has been described above, peak detection can be performed with high precision and condition parameters for pitch extraction can be easily changed in a simple, inexpensive arrangement regardless of variations in circuit components and deteriorations over time.

What is claimed is:

1. An input control apparatus for an electronic system, comprising:

means for converting an input waveform signal into a digital waveform signal A;

memory means for storing a digital waveform signal B;

means for reducing a value of the digital waveform signal B stored in said memory means at a predetermined rate;

means for comparing the digital waveform signal B stored in said memory means with the digital waveform signal A supplied from said converting means; and control means for causing said memory means to store the digital waveform signal A supplied from said converting means as the digital waveform signal B when said comparing means detects that the digital waveform signal A supplied from said converting means is larger than the digital waveform signal B stored in said memory means, and for inhibiting changing the digital waveform signal B stored said memory means with the digital waveform signal A when said comparing means detects that the digital signal A supplied from said converting means is smaller than the digital waveform signal B stored in said memory means, wherein a peak timing of the input waveform signal is detected on the basis of a comparison output from said comparing means.

2. An apparatus according to claim 1, wherein a predetermined value subtracted from the digital waveform signal B in said reducing means is a predetermined value or a value obtained by multiplying the digital waveform signal B supplied from said memory means with 1/n where n is a value larger than 1.

3. An apparatus according to claim 1, wherein a predetermined value subtracted from the digital wave signal B in said reducing means is a value obtained by multiplying the digital waveform signal B supplied from said memory means with 1/n where n is a value larger than 1, and said reducing means comprises means for changing a 1/n value on the basis of a lapse from a previous peak timing.

4. An apparatus according to claim 1, wherein said reducing means comprises means for changing the predetermined rate used for subtracting a predetermined value from the digital waveform signal B on the basis of a period of the input waveform signal.

5. An input control apparatus for an electronic musical instrument of a type having a plurality of strings to extract a pitch from a vibration signal generated upon vibrations of the strings and electrically generate an acoustic signal having a frequency corresponding to the extracted pitch, comprising: means for converting an input waveform signal into digital waveform signals Ai, where i corresponds to a string number of the strings;

memory means for storing digital waveform signals Bj, where j corresponds to the string number of the strings;

means for subtracting a predetermined value from the digital waveform signal Bj of each string stored in said memory means at a predetermined rate;

means for comparing the digital waveform signal Bj stored in said memory means with the digital waveform signal Ai supplied from said converting means in units of strings (i=j); and control means for causing said memory means to store the digital waveform signal Ai supplied from said converting means as the corresponding digital waveform signal Bj (j=i) in said memory means when said comparing means detects that the digital waveform signal Ai supplied from said converting means is larger than the corresponding digital waveform signal Bj (j=i) stored in said memory means, and for inhibiting changing the digital waveform signal Bj stored in the memory means with the digital waveform signal Ai when said comparing means detects that the digital waveform signal Ai supplied from said converting means is smaller than the corresponding digital waveform signal Bj (j=i) stored in said memory means, wherein peak timings of the input waveform signals generated upon vibrations of the plurality of strings are detected on the basis of a comparison result from said comparing means.

6. An apparatus according to claim 5, wherein a positive waveform value of the input waveform signal is output without modifications and a negative waveform value thereof is inverted, thereby converting the input waveform signal into the digital waveform signal Ai from said converting means in units of strings;

said memory means stores positive digital waveform signals BjU and negative digital waveform signals BjD, where j corresponds to the string number of the respective strings;

said subtracting means subtracts a predetermined value from the positive and negative digital waveform signals BjU and BjD at a predetermined rate;

said comparing means compares one of the digital waveform signals BjU and BjD stored in said memory means with the corresponding digital waveform signal Ai supplied from said converting means in units of strings (j=i); and said control means updates a corresponding one of the digital waveform signals BjU and BjD as storage contents of said memory means with the digital waveform signal Ai (i=j) and detects positive and negative peak timings of the input waveform signal upon vibrations of the plurality of strings on the basis of a comparison result of said comparing means.

7. An apparatus according to claim 5, wherein the predetermined rate for subtracting the predetermined value the digital waveform signal Bj in said substractive means is changed in accordance with the string number j.

8. An apparatus according to claim 6, wherein the predetermined rate for subtracting the predetermined value from the digital waveform signals BjU and BjD in said substracting means is changed in accordance with the string number j.

9. An input control apparatus for an electronic system, comprising:

means for supplying a digital waveform signal A whose waveform is periodically changed;

memory means for storing a digital waveform signal B;

processing means for reducing a level of the digital waveform signal B stored in said memory means at a predetermined rate;

means for comparing the digital waveform signal B stored in said memory means with the digital waveform signal A supplied from said supplying means;

control means for causing said memory means to store the digital waveform signal A supplied from said supplying means as the digital waveform signal B when said comparing means detects that the digital waveform signal A supplied from said supplying means is larger than the digital waveform signal B stored in said memory means, and for inhibiting storing the digital waveform signal A into the memory means when said comparing means detects that the digital waveform signal A supplied from said supplying means is smaller than the digital waveform signal B stored in said memory means; and peak timing signal generating means for detecting a peak timing of the digital waveform signal and for generating a peak timing signal on the basis of a comparison result of said comparing means.

10. An apparatus according to claim 9, further comprising:

time interval measuring means for measuring a time interval between timings sequentially designated by the peak timing signal from said peak timing signal generating means; and period determining means for determining a period of digital waveform signal A supplied from said supplying means in accordance with the time interval measured by said time interval measuring means.

11. An apparatus according to claim 10, wherein said time interval measuring means measures a time interval between peak points designated by the peak timing signal.

12. An apparatus according to claim 10, wherein said time interval measuring means measures a time interval between zero-crossings immediately after a peak point designated by the peak timing signal.

* * * * *